US007769325B2

(12) United States Patent
Aruga et al.

(10) Patent No.: US 7,769,325 B2
(45) Date of Patent: Aug. 3, 2010

(54) DEVELOPER CONVEYING APPARATUS AND IMAGE FORMING APPARATUS USING THE SAME

(75) Inventors: Tomoe Aruga, Naganoken (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 147 days.

(21) Appl. No.: 12/168,732

(22) Filed: Jul. 7, 2008

(65) Prior Publication Data

US 2009/0035022 A1 Feb. 5, 2009

(30) Foreign Application Priority Data

Jul. 30, 2007 (JP) ..... 2007-197448
Feb. 19, 2008 (JP) ..... 2008-036760

(51) Int. Cl.
*G03G 15/10* (2006.01)
*G03G 21/10* (2006.01)

(52) U.S. Cl. ..... 399/237; 399/249; 399/358

(58) Field of Classification Search ..... 399/237, 399/249, 348, 358
See application file for complete search history.

(56) References Cited

U.S. PATENT DOCUMENTS 5,708,952 A 1/1998 Taniguchi et al.
5,893,012 A 4/1999 Schubert et al.
6,466,763 B1 10/2002 Campbell et al.
7,043,178 B1 5/2006 Taylor et al.
2005/0002707 A1* 1/2005 Choi et al. ..... 399/358
2006/0210315 A1 9/2006 Nakamura et al.
2007/0140739 A1* 6/2007 Aruga et al. ..... 399/249
2007/0160391 A1 7/2007 Takano et al.

FOREIGN PATENT DOCUMENTS

JP 05-057993 3/1993
JP 2006106114 A 4/2006
JP 2006-251669 A * 9/2006
JP 2007-140410 A * 6/2007

OTHER PUBLICATIONS

European Search Report for corresponding Europeans application 08011449.9-1240 lists the references above , issued Nov. 2008.

* cited by examiner

*Primary Examiner*—Sophia S Chen
(74) *Attorney, Agent, or Firm*—Hogan Lovells US LLP

(57) ABSTRACT

An image forming apparatus includes a reservoir base section with a recess that receives liquid developer scraped off of a developing roller by a cleaning blade. The recess is substantially U-shaped with an opened top side and an arc angle of not less than 180°. A conveying base station is continuous with the reservoir base section and has a conveying port formed thereon. A conveying member arranged in the reservoir and conveying base sections conveys liquid developer through a hollow path from the recess to the conveying port by rotating about its axis. The radius r1 of the outer periphery of the conveying member, the radius r2 of the conveying port and the radius r3 of curvature of the recess have the relationship r1<r2<r3.

4 Claims, 22 Drawing Sheets

A-A

A-A

A-A

A-A

A-A

A-A

B-B

B-B

DEVELOPER CONVEYING APPARATUS AND IMAGE FORMING APPARATUS USING THE SAME

CROSS REFERENCE TO RELATED APPLICATIONS

This application is based upon and claims the benefit of priority from the prior Japanese Patent Application No. 2007-197448, filed on Jul. 30, 2007, and the prior Japanese Patent Application No. 2008-36760, filed on Feb. 19, 2008, the entire contents of which including the specifications, the drawings and the abstracts thereof are incorporated herein by reference.

BACKGROUND OF THE INVENTION

1. Field of the Invention

The present invention relates to a developer conveying apparatus for conveying the residual liquid developer produced in image forming processes and stored in a developer reservoir and also to an image forming apparatus using such a developer conveying apparatus.

2. Description of the Related Art

Various wet image forming apparatus for forming an image by developing an electrostatic latent image by means of a high viscosity and high concentration developer prepared by dispersing solid toner into a liquid solvent and visualizing the latent image have been proposed to date. Developers to be employed in such wet image forming apparatus are mostly prepared by dispersing solid (toner particles) into an electrically insulating and highly viscous organic solvent (carrier liquid) such as silicon oil, mineral oil or edible oil to suspend the former in the latter. Such toner particles are very fine and have a particle size of about 1 μm or so. Due to the use of such fine toner particles, wet image forming apparatus can produce high quality images when compared with dry image forming apparatus adapted to use powdery toner particles having a particle size of about 7 μm. The carrier liquid of developer has a function of holding toner particles in an electrically charged state and uniformly dispersing them in addition to that of preventing toner particles having a particle size of 1 μm or so. Additionally, it takes a role of not allowing toner particles to move with ease by means of an electric field effect in the developing and transferring steps.

Such image forming apparatus are required to use a developer conveying apparatus specifically designed to convey developer. A known developer conveying apparatus is described in Patent Document 1 (JP 05-57993-A). The developer conveying apparatus described in the above-cited Patent Document 1 is adapted to supply developer that contains toner to a development position and mix it with the developer newly supplied from a developer supply port. It is a structure for conveying developer by means of revolutions of a developer conveying screw and circulating the developer through a developer mixing/conveying section and a developer reservoir located adjacent to the developer mixing/conveying section to store the developer that is left after developing an image on a developing roller. It is equipped with a control means for controlling the flow of developer when circulating the developer through the developer mixing/conveying section and the developer reservoir.

SUMMARY OF THE INVENTION

Since a developer conveying apparatus described in the above-cited Patent Document 1 is adapted to circulate developer through a developer mixing/conveying section and a developer reservoir that are arranged adjacent relative to each other in a closed loop, it is accompanied by a problem that conveyance of the residual liquid developer produced in an image forming process is not taken into consideration, although the developer newly supplied from the developer supply port is smoothly driven to flow into the developer mixing/conveying section by gravity.

There is an additional problem that toner particles in the residual liquid developer produced from the image forming process and stored in the developer reservoir are apt to agglomerate and the toner concentration in the developer is nonuniform to make it difficult to handle the residual liquid developer.

There is still another additional problem that the residual liquid developer is electrically charged and therefore can be electrostatically adsorbed to the surfaces of the developer conveying screw and the component member or members of the developer mixing/conveying section to give rise to a situation where the operation of conveying the developer can no longer be realized.

In short, when a developer conveying apparatus as described in the above cited Patent Document 1 is employed in an image forming apparatus, there arises a problem that the process of recycling residual liquid developer and that of disposing residual liquid developer as waste cannot be conducted smoothly.

According to the present invention, the above-identified problems and other problems are dissolved by providing a developer conveying apparatus including: a developer reservoir for storing developer; a conveying member arranged in the developer reservoir to convey the developer by rotating around the axis thereof; and a hollow path containing the conveying member in the inside thereof and guiding the developer being conveyed by the conveying member.

Preferably, in a developer conveying apparatus as defined above, the developer reservoir includes a reservoir base section having a recess and a conveying base section having the hollow path arranged therein.

Preferably, in a developer conveying apparatus as defined above, when the radius of the outer periphery of the conveying member is r1 and the radius of the conveying port is r2, while the radius of curvature of the recess is r3, they show a relationship of $r1 < r2 < r3$.

Preferably, in a developer conveying apparatus as defined above, the conveying member is a screw.

Preferably, in a developer conveying apparatus as defined above, the conveying member has a spiral blade.

Preferably, in a developer conveying apparatus as defined above, a spring member is contained in the hollow path and connected to an end of the conveying member.

In another aspect of the present invention, there is provided an image forming apparatus including: a roller for holding developer; a roller cleaning blade adapted to be brought into contact with the roller and scrape off the developer held by the roller; and a developer conveying apparatus including: a developer reservoir for receiving the developer scraped off by the roller cleaning blade; a conveying member arranged in the developer reservoir to convey the developer by rotating around the axis thereof; and a hollow path containing the conveying member in the inside thereof and guiding the developer being conveyed by the conveying member.

Preferably, in an image forming apparatus as defined above, the roller is a developing roller.

Preferably, in an image forming apparatus as defined above, the roller is an image carrier squeezing roller held in contact with an image carrier.

Preferably, in an image forming apparatus as defined above, the conveying memory is a screw.

Preferably, in an image forming apparatus as defined above, the blade winding pitch of the screw for conveying the developer scraped off from the image carrier and the blade winding pitch of the screw for conveying the developer scraped off from the developing roller are different from each other.

Preferably, in an image forming apparatus as defined above, the number of revolutions per unit time of the screw for conveying the developer scraped off from the image carrier and the number of revolutions per unit time of the screw for conveying the developer scraped off from the developing roller are different from each other.

Preferably, in an image forming apparatus as defined above, a plurality of developer reservoirs are provided.

Preferably, in an image forming apparatus as defined above, the developer reservoir includes a reservoir base section having a recess and a conveying base section connected to the hollow path.

Preferably, in an image forming apparatus as defined above, a spring member substantially contained in the hollow path is connected to an end of the conveying member.

A developer conveying apparatus according to the present invention can convey residual liquid developer where toner particles in an electrically charged state agglomerate or the toner concentration in the developer to be conveyed is non-uniform. Then, as a result, the process of recycling residual liquid developer and that of disposing residual liquid developer as waste can be conducted smoothly.

A developer conveying apparatus according to the present invention prevents a situation where toner particles of residual liquid developer is electrically charged and electrostatically adsorbed to the surfaces of the component or components of the conveying section to make it no longer possible to realize the operation of conveying residual liquid developer from taking place.

An image forming apparatus comprising a developer conveying apparatus according to the present invention can improve the efficiency of conveying residual liquid developer and is freed from a structure of circulating developer in a closed loop so that it allows to temporarily convey developer from a developing site to some other position to mix it with additional developer and dissolve the situation where toner particles agglomerate and show uneven concentration so that toner may be dispersed in a desired manner, while it also allows to dispose unnecessary developer as waste.

The following embodiment can also be provided within the scope of the present invention and will be referred to as reference embodiment hereinafter. The embodiment of developer conveying apparatus according to the present invention comprises a reservoir base member for storing developer formed by dispersing toner particles in carrier liquid; a conveyance base member arranged at a longitudinal end of the reservoir base member and adapted to suck in developer stored from the reservoir base member; a conveying screw rotatably supported by and held in contact with the reservoir base member and provided with a spiral blade of a predetermined winding pitch; and a suction port formed in the conveyance base member containing the spiral blade with a diameter smaller than the radius of curvature of the recess covering the conveying screw of the reservoir base member; the conveying screw extending into the conveyance base member.

Preferably, the reference embodiment of developer conveying apparatus as defined above further comprises a pipe member arranged at the end of the reservoir base member opposite to the end provided with the conveyance base member and held in communication with the suction port, the conveying screw extending into the pipe member.

Preferably, the reference embodiment of developer conveying apparatus as defined above further comprises a spring member arranged at the end of the conveying screw extending into the pipe member and contained in the pipe member.

A reference embodiment of image forming apparatus according to the present invention comprises a plurality of developer conveying apparatus according to the present invention.

Preferably, the reference embodiment of image forming apparatus as defined above further comprises a developer conveying structure for conveying the developer scraped off from the image carrier and a developer conveying structure for conveying the developer scraped off from the developing roller.

Preferably, in the reference member of image forming apparatus as defined above, the blade winding pitch of the conveying screw of the developer conveying structure for conveying the developer scraped off from the image carrier and the blade winding pitch of the conveying screw of the developer conveying structure for conveying the developer scraped off from the developing roller are different from each other.

Preferably, in the reference embodiment of image forming apparatus as defined above, the number of revolutions per unit time of the conveying screw of the developer conveying structure for conveying the developer scraped off from the image carrier and the number of revolutions per unit time of the conveying screw of the developer conveying structure for conveying the developer scraped off from the developing roller are different from each other.

The reference embodiment of developer conveying apparatus according to the present invention can convey residual liquid developer where toner particles in an electrically charged state agglomerate or the toner concentration in the developer to be conveyed is nonuniform. Then, as a result, the process of recycling residual liquid developer and that of disposing residual liquid developer as waste can be conducted smoothly.

The reference embodiment of developer conveying apparatus according to the present invention prevents a situation where toner particles of residual liquid developer is electrically charged and electrostatically adsorbed to the surfaces of the component or components of the conveying section to make it no longer possible to realize the operation of conveying developer from taking place.

The reference embodiment of image forming apparatus comprising a developer conveying apparatus according to the present invention can improve the efficiency of conveying residual liquid developer and is freed from a structure of circulating developer in a closed loop so that it allows to temporarily convey developer from a developing site to some other position to mix it with additional developer and dissolve the situation where toner particles agglomerate and show uneven concentration so that toner may be dispersed in a desired manner, while it also allows to dispose unnecessary developer as waste.

DETAILED DESCRIPTION OF THE PREFERRED EMBODIMENTS

Figure 1:
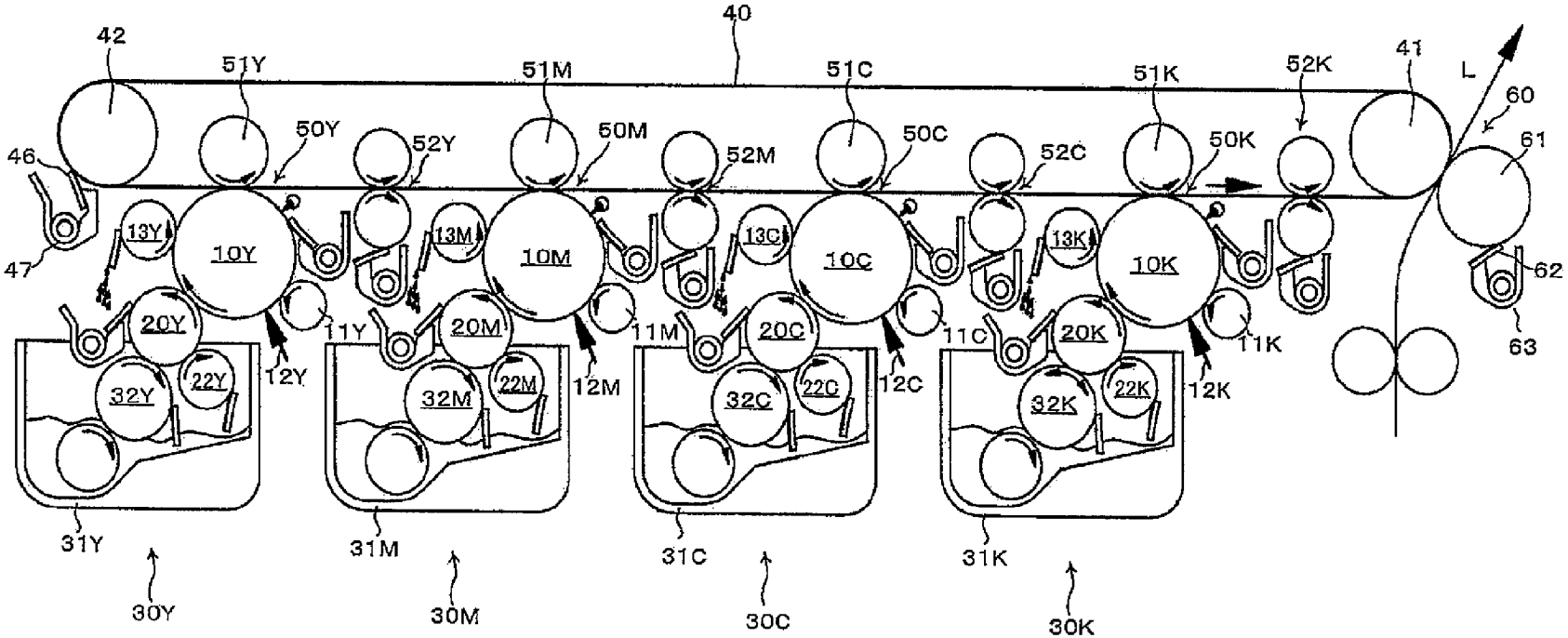
FIG. 1 is a schematic illustration of an image forming apparatus comprising an embodiment of developer conveying apparatus according to the present invention, showing principal components thereof.

Now, preferred embodiments of the present invention will be described below by referring to the accompanying drawings. FIG. 1 is a schematic illustration of an image forming apparatus comprising an embodiment of developer conveying apparatus according to the present invention, showing principal components thereof. Image forming sections of different colors are arranged in a central part of the image forming apparatus and developing units 30Y, 30M, 30C, 30K are arranged in a lower part of the image forming apparatus whereas an intermediate transfer body 40 and a secondary transfer section 60 are arranged in an upper part of the image forming apparatus.

The image forming sections include image carriers 10Y, 10M, 10C, 10K, charging rollers 11Y, 11M, 11C, 11K and exposure units (not shown) 12Y, 12M, 12C, 12K as well as other components. The exposure units 12Y, 12M, 12C, 12K have respective optical systems including semiconductor lasers, polygon mirrors and F-θ lenses. The image carriers 10Y, 10M, 10C, 10K are electrically uniformly charged by the respective charging rollers 11Y, 11M, 11C, 11K and electrostatic latent images are formed respectively on the electrically charged image carriers 10Y, 10M, 10C, 10K by irradiating modulated laser beams from the exposure units 12Y, 12M, 12C, 12K according to the input image signals.

The developing units 30Y, 30M, 30C, 30K include developing rollers 20Y, 20M, 20C, 20K, developer containers (reservoirs) 31Y, 31M, 31C, 31K storing developers of different colors of yellow (Y), magenta (M), cyan (C) and black (K) and anilox rollers 32Y, 32M, 32C, 32K for supplying developers of the respective colors from the developer containers 31Y, 31M, 31C, 31K and develop the electrostatic latent images formed on the image carriers 10Y, 10M, 10C, 10K by means of developers of the different colors. The developing units 30Y, 30M, 30C, 30K are removably mounted in the image forming apparatus main body.

Image carrier squeezing rollers 13Y, 13M, 13C, 13K are respectively held in contact with the image carriers 10Y, 10M, 10C, 10K to exert an squeezing effect on them. Toner compression rollers 22Y, 22M, 22C, 22M are arranged respectively along the developing rollers 20Y, 20M, 20C, 20K to exert an compaction effect on them. The toner compression rollers 22Y, 22M, 22C, 22K may be held constantly in contact with or in a non-contact state relative to the respective developing rollers 20Y, 20M, 20C, 20K.

The intermediate transfer body 40 is an endless belt member extending between a drive roller 41 and tension roller 42 so as to be driven to rotate by the drive roller 41, contacting the image carriers 10Y, 10M, 10C, 10K at primary transfer sections 50Y 50M, 50C, 50K respectively. Primary transfer rollers 51Y, 51M, 51C, 51K are arranged respectively opposite to the image carriers 10Y, 10M 10C, 10K with the intermediate transfer body 40 interposed between them at the primary transfer sections SOY, 50M, 50C, 50K so that the developed toner images of the different colors on the image carriers 10Y, 10M, 10C, 10K are sequentially transferred onto the intermediate transfer body 40 and laid one on the other at the transfer positions, or the contact positions of the primary transfer rollers 51Y, 51M, 51C, 51K and the image carriers 10Y, 10M, 10C, 10K, to produce a full color toner image.

Secondary transfer unit 60 includes a secondary transfer roller 61 that is arranged opposite to the belt drive roller 41 with the intermediate transfer body 40 and a cleaning apparatus that by turn includes a secondary transfer roller cleaning blade 62 and a developer reservoir 63. Then, a monochromatic toner image or a full color toner image formed on the intermediate transfer body 40 is transferred for secondary transfer onto a recording medium, which may be a sheet of paper, a sheet of film or a sheet of cloth, being conveyed along sheet conveying route L, at the transfer position where the secondary transfer roller 61 is arranged.

A fixing unit (not shown) is arranged at a downstream position of the sheet conveying route L to fuse the monochromatic toner image or the full color toner image transferred onto the recording medium, or the sheet, and fix it to the latter.

The tension roller 42 bears the intermediate transfer body 40 extending between itself and the belt drive roller 41. A cleaning apparatus including an intermediate transfer body cleaning blade 46 and a developer reservoir 47 is arranged at a position in the area where intermediate transfer body 40 is borne by and held in contact with the tension roller 42.

Figure 2:
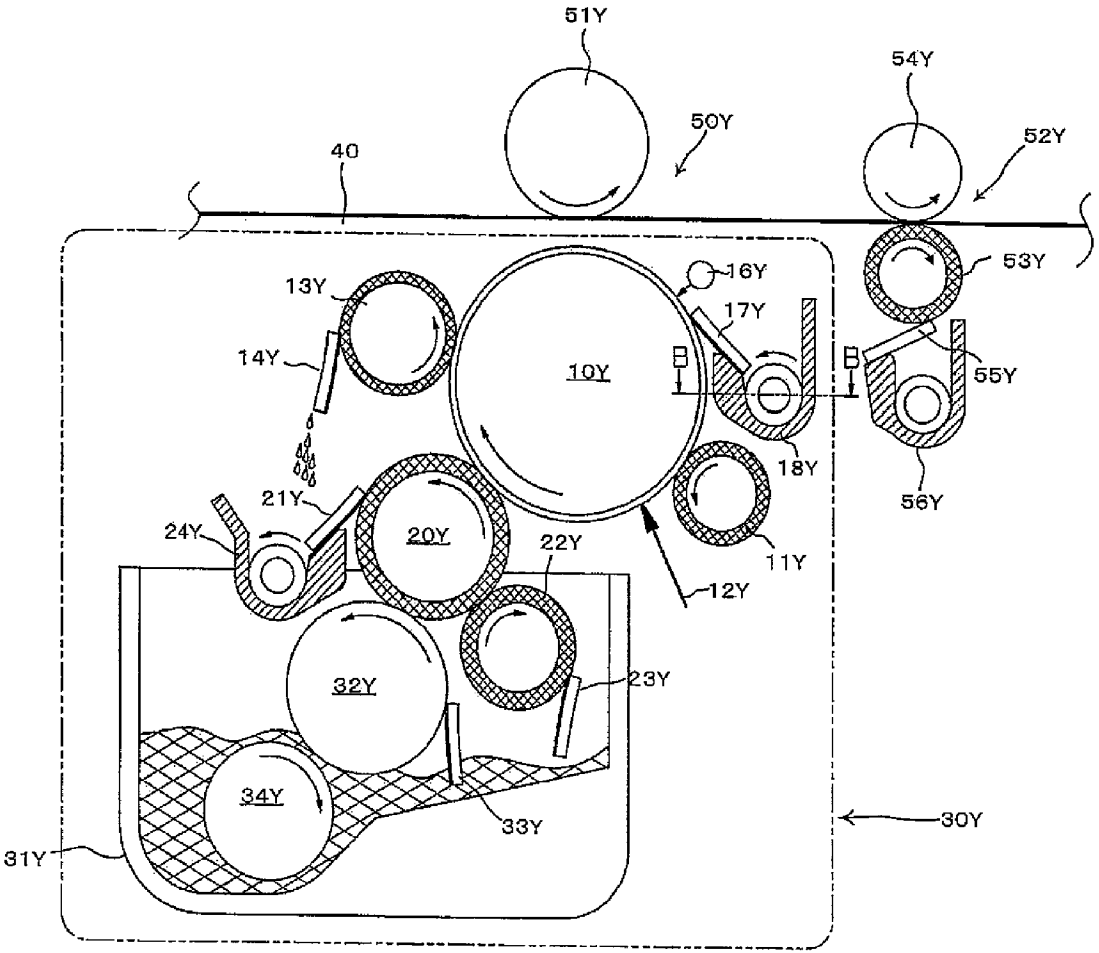
FIG. 2 is a schematic cross-sectional view of one of the image forming section and the corresponding one of the development units of the embodiment of FIG. 1, showing principal components thereof.
Figure 3:
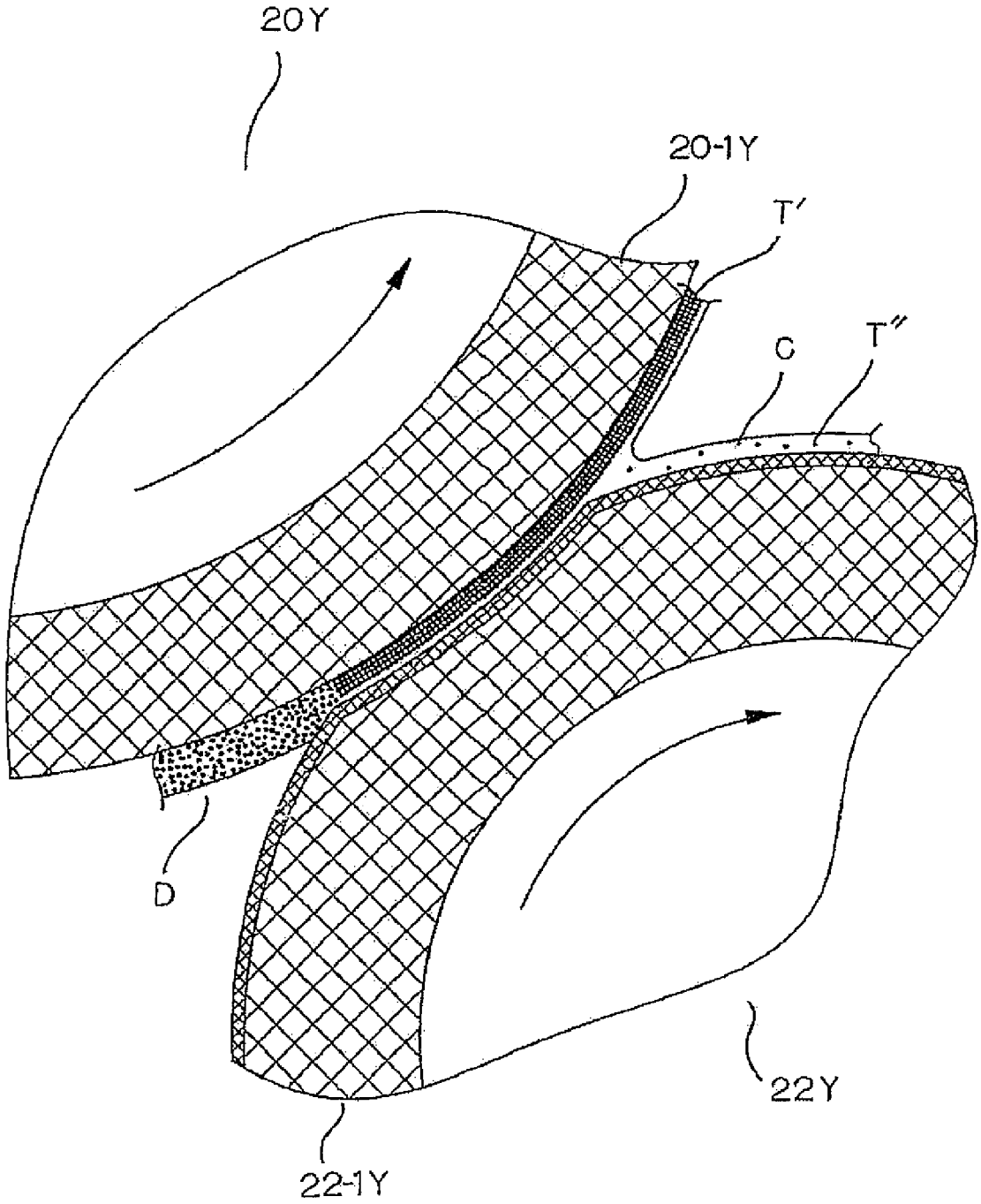
FIG. 3 is a schematic illustration of a compaction that can be produced by the toner compression roller 22Y of the embodiment of FIG. 1.
Figure 4:
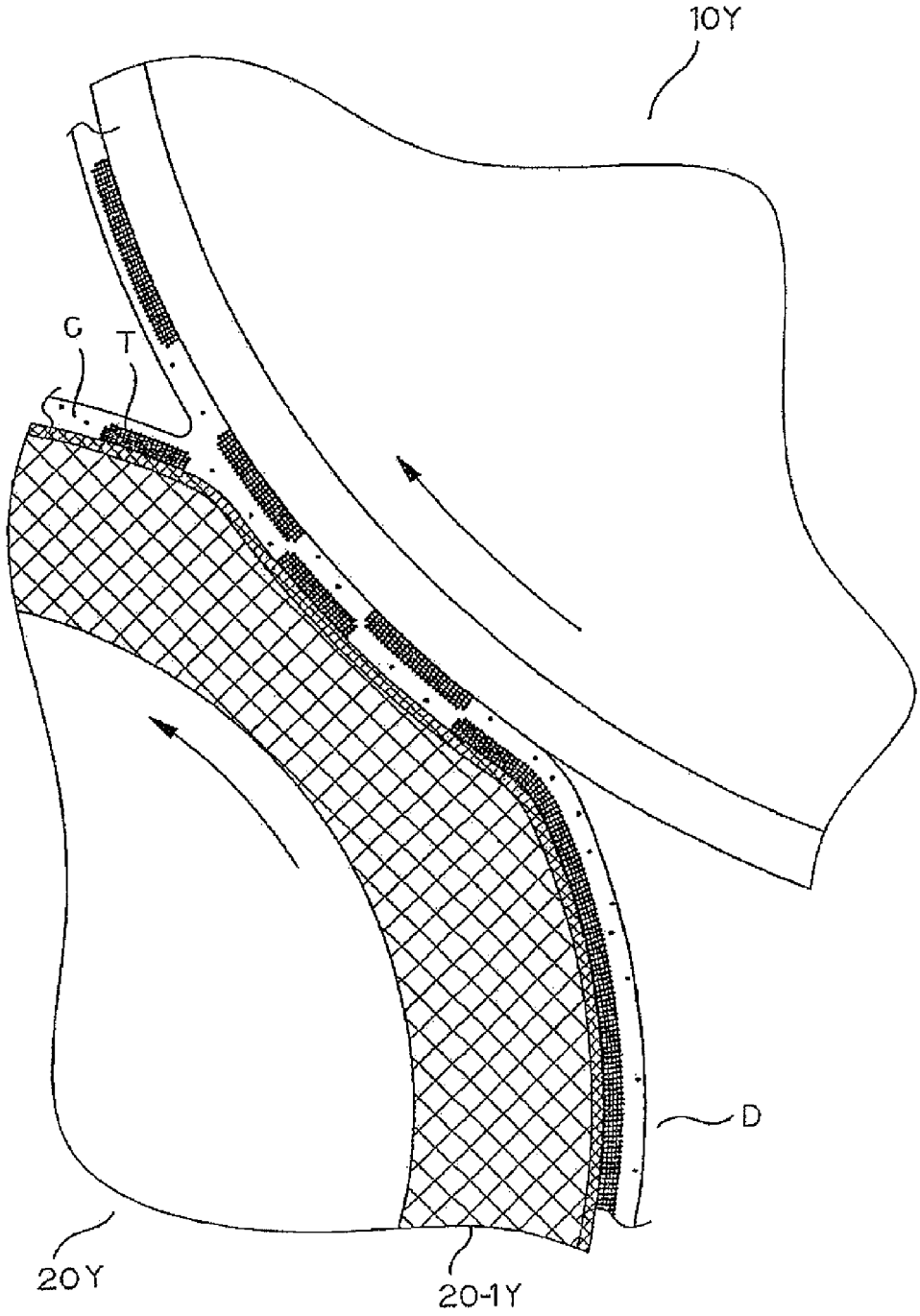
FIG. 4 is a schematic illustration of the development process of the developing roller 20Y of the embodiment of FIG. 1.
Figure 5:
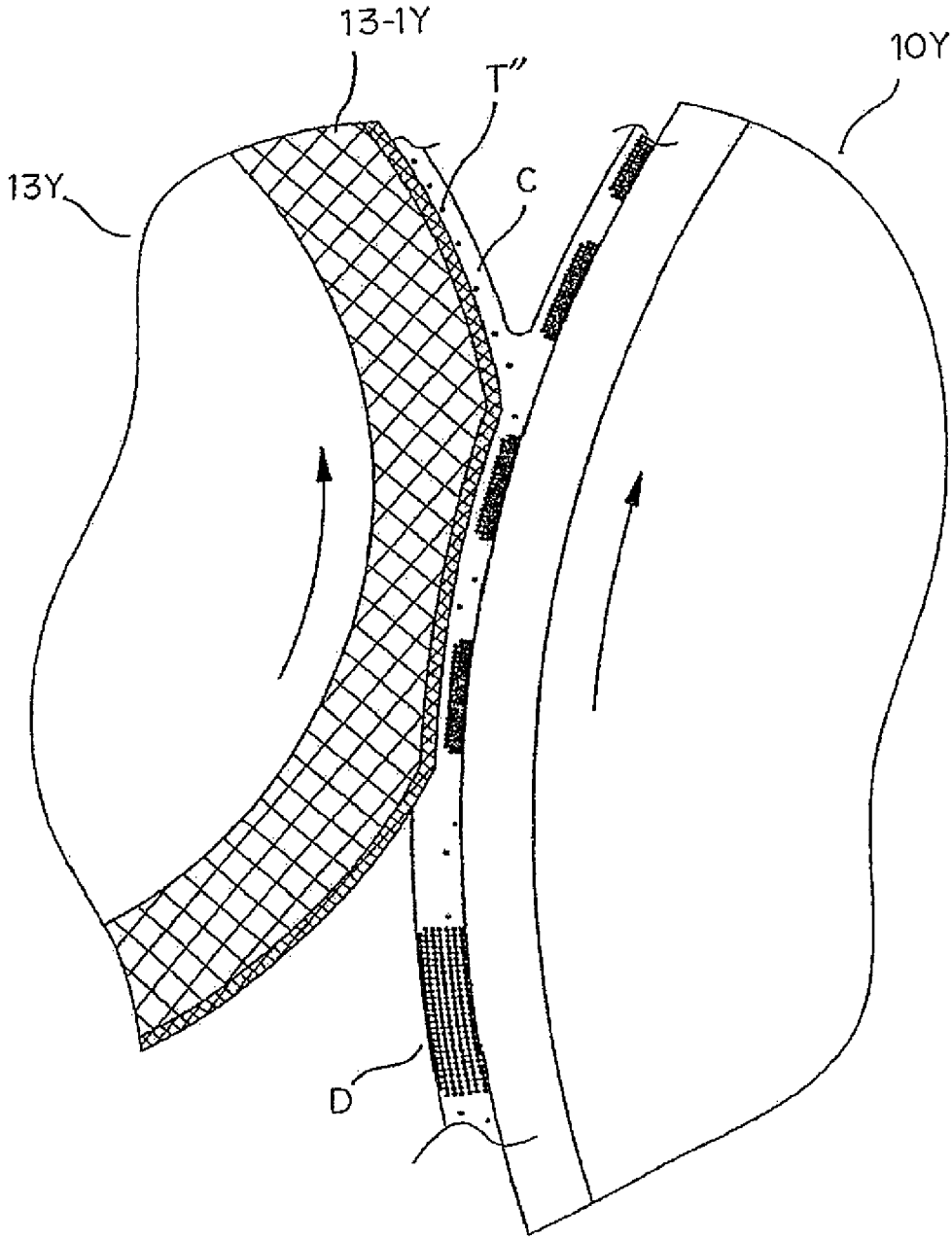
FIG. 5 is a schematic illustration of the squeezing effect of the image carrier squeezing roller 13Y of the embodiment of FIG. 1.
Figure 6:
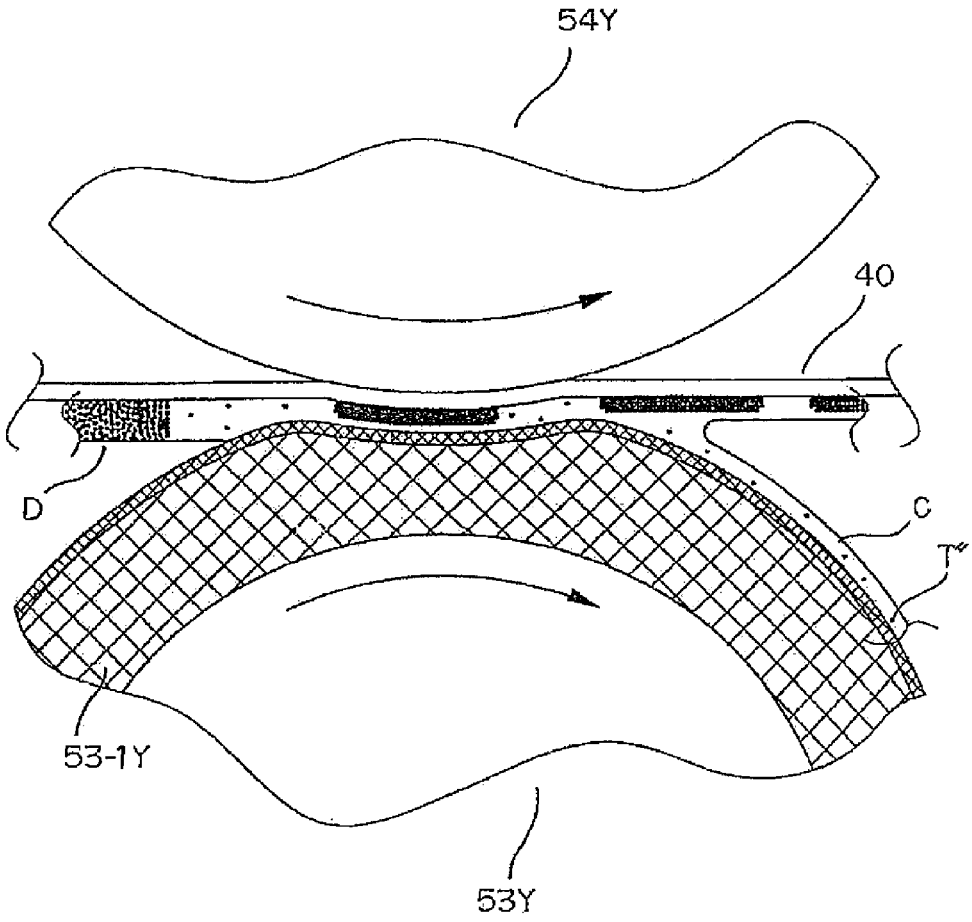
FIG. 6 is a schematic illustration of the squeezing effect of the intermediate transfer squeezing apparatus 52Y of the embodiment of FIG. 1.

Now, the image forming sections and the developing units will be described below. FIG. 2 is a schematic cross-sectional view of one of the image forming section and the corresponding one of the development units of this embodiment, showing principal components thereof. FIG. 3 is a schematic illustration of a compaction that can be produced by the toner compression roller 22Y of this embodiment. FIG. 4 is a schematic illustration of the development process of the developing roller 20Y of this embodiment. FIG. 5 is a schematic illustration of the squeezing effect of the image carrier squeezing roller 13Y of this embodiment. FIG. 6 is a schematic illustration of the squeezing effect of the intermediate transfer squeezing apparatus 52Y of this embodiment. Since the image sections and the developing units of the different colors are structurally identical, only the image forming section and the developing unit for yellow (Y) images will be described below.

In the image forming section, a cleaning apparatus including a latent image eraser 16Y, an image carrier cleaning blade 17Y and a developer reservoir 18Y, the charging roller 11Y, the exposure unit 12Y, the developing roller 20Y of the developing unit 30Y and another cleaning apparatus including the image carrier squeezing roller 13Y and the image carrier squeezing roller cleaning blade 14Y that is an annex to the image carrier squeezing roller 13Y are arranged clockwise in the mentioned order around the outer periphery of the image carrier 10Y. A cleaning apparatus including a developing roller cleaning blade 21Y and a developer reservoir 24Y, an anilox roller 32Y and the toner compression roller 22Y are arranged around the outer periphery of the developing roller 20Y of the developing unit 30Y.

A carrier quantity adjusting blade 23Y is arranged along the outer periphery of the toner compression roller 22Y. The developer container 31Y contains in the inside thereof a developer feed roller 34Y and part of the anilox roller 32Y. The primary transfer roller 51Y is arranged at the position opposite to the image carrier 10Y and along the intermediate transfer body 40 and an intermediate transfer body cleaning apparatus 52Y including an intermediate transfer body squeezing roller 53Y, a backup roller 54Y, an intermediate transfer body squeezing roller cleaning blade 55Y and a developer reservoir 56Y is arranged at a position downstream relative to the primary transfer section in the moving direction of the intermediate transfer body 40.

The image carrier 10Y is a photosensitive drum prepared by using a cylindrical member with a photosensitive layer formed on the outer peripheral surface thereof. It is typically so adapted to rotate clockwise as shown in FIG. 2. The photosensitive layer of the image carrier 10Y is typically an amorphous silicon image carrier. The charging roller 11Y is arranged at a position upstream relative to the nip section including the image carrier 10Y and the developing roller 20Y in the rotational direction of the image carrier 10Y. A bias voltage showing a polarity same as the polarity of the electric charge of toner is applied from a power supply (not shown) to the charging roller 11Y in order to electrically charge the image carrier 10Y. The exposure unit 12Y irradiates a laser beam onto the image carrier 10Y that has been electrically charged by the charging roller 11Y at a position downstream relative to the charging roller 11Y in the rotational direction of the image carrier 10Y to form a latent image on the image carrier 10Y.

The developing unit 30Y includes the toner compression roller 22Y, the developer container 31Y storing developer in a state where toner is dispersed in a carrier to a weight ratio of about 20%, the developing roller 20Y for bearing the liquid developer, a combination of the anilox roller 32Y, a control blade 33Y and the feed roller 34Y for agitating the developer in the developer container 31Y to hold it in a uniformly dispersed state and supplying the liquid developer to the developing roller 20Y, the toner compression roller 22Y for bringing the developer borne by the developing roller 20Y into a compact state and a developing roller cleaning blade 21Y for cleaning the developing roller 20Y.

Figure 7:
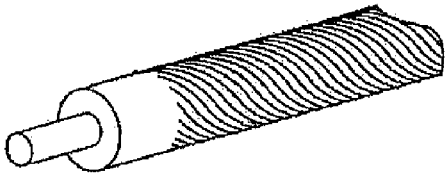
FIG. 7 is a schematic perspective view of an anilox roller, showing an external appearance thereof.

FIG. 7 is a schematic perspective view of an anilox roller, showing an external appearance thereof. The anilox roller 32Y and the feed roller 34Y are so arranged as to be driven to rotate in opposite directions relative to each other. As the anilox roller 32Y and the feed roller 34Y are driven to rotate in opposite directions relative to each other, the feed roller 34Y can form a uniform film of developer on the anilox roller 32Y.

The developer contained in the developer container 31Y is a highly concentrated and highly viscous non-volatile liquid developer that is non-volatile at room temperature. More specifically, a liquid developer that can be used for the purpose of the present invention is a highly viscous liquid developer (with a viscosity of about 30 to 10,000 mPa·s) prepared by adding solid particles having an average particle size of 1 μm and formed by dispersing a coloring agent such as a pigment in a thermoplastic resin substance to a liquid solvent such as an organic solvent, silicon oil, mineral oil, or edible oil along with a dispersant to make the solid toner concentration equal to about 20%.

The toner particles in the liquid developer contained in the developer container 31Y have a positive electric charge. The liquid developer is agitated by the feed roller 34Y and pumped up from the developer container 31Y as the anilox roller 32Y is driven to rotate.

The control blade 33Y is prepared by using a resilient blade formed by arranging a resilient material on the surface, a rubber section typically made of urethane rubber so as to brought into contact with the surface of the anilox roller 32Y and a plate typically made of metal that supports the rubber section. It controls and adjusts the film thickness and the quantity of the liquid developer borne and conveyed by the anilox roller 32Y and also adjusts the quantity of liquid developer being fed to the developing roller 20Y.

The developing roller 20Y is a cylindrical member that is about 320 mm wide and driven to rotate counterclockwise around the axis of rotation thereof as shown in FIG. 2. The developing roller 20Y is formed by arranging a resilient layer 20-1Y of polyurethane, silicon rubber or NBR on the outer peripheral surface of an inner core made of a metal such as iron. The developing roller cleaning blade 21Y is made of rubber and adapted to be brought into contact with the surface of the developing roller 20Y. It is arranged downstream relative to the developing nip section where the developing roller 20Y is held in contact with the image carrier 10Y in the rotational direction of the developing roller 20Y so as to scrape off the liquid developer remaining on the developing roller 20Y.

The toner compression roller 22Y is a cylindrical member and, like the developing roller 20Y, it is coated with a resilient member 22-1Y so as to operate as a resilient roller as seen from FIG. 3. More specifically, it is formed by arranging an electro-conductive resin or rubber layer on the surface of a metal roller base member and driven to rotate clockwise opposite to the developing roller 20 as seen from FIG. 2. The toner compression roller 22Y has a means for raising the charged bias of the surface of the developing roller 20Y. The developer conveyed by the developing roller 20Y applies a bias electric field from the side of the toner compression roller 22Y toward the developing roller 20Y at the toner compressing site where the toner compression roller 22Y contacts the developing roller 20Y to give rise to a nip as shown in FIGS. 2 and 3. The application of a bias will be described in greater detail hereinafter. It may alternatively be so arranged that the toner compression roller 22Y does not contact the developing roller 20Y if a satisfactory toner compressing function is provided.

As shown in FIG. 3, the toner T that is uniformly dispersed in the carrier C is forced to move to the side of the developing roller 20Y and agglomerate there by the toner compression roller 22Y so as to fall into a so-called "toner-compressed" condition T'. At the same time, the toner compression roller 22Y bears part of the carrier C and also part of the toner T" that is not driven to fall into a "toner-compressed" condition and is driven to rotate in the direction as indicated by an arrow in FIG. 3. The carrier and the toner borne by the toner compression roller 22Y are scraped off by the carrier quantity adjusting blade 23Y and added to the developer in the reservoir 31Y for reuse. On the other hand, the "toner-compressed" developer D that is borne by the developing roller 20Y is consumed to develop the latent image borne by the image carrier 10Y as a desired electric field is applied at the developing nip section where the developing roller 20Y abuts the image carrier 10Y.

The image carrier squeezing apparatus is arranged vis-a-vis the image carrier 10Y at the downstream side relative to the developing roller 20Y to collect the residual liquid developer remaining after the toner image is developed on the image carrier 10Y. As shown in FIGS. 2 and 5, it includes an image carrier squeezing roller 13Y that is a resilient roller member having a resilient body 13-1Y formed on the surface and held in contact with the image carrier 10Y to rotate and a cleaning blade 14Y pressed against the image carrier squeezing roller 13Y to clean the surface of the squeezing roller 13Y. As shown in FIG. 5, the image carrier squeezing apparatus has a function of collecting the residual carrier C and the fogging toner T" that is intrinsically unnecessary from the developer D consumed for developing the latent image on the image carrier 10Y to raise the toner particle ratio in the visible image. The capacity of the image carrier squeezing apparatus for collecting residual carrier C can be set to a desired level by selecting the rotational direction of the image carrier squeezing roller 13Y and the peripheral speed difference between the peripheral speed of the surface of the image carrier 10Y and that of the surface of the image carrier squeezing roller 13Y. The collecting capacity is raised by driving the image carrier squeezing roller 13Y to rotate in the direction opposite to the rotational direction of the image carrier 10Y and also by selecting a large peripheral speed difference. A synergetic effect can be achieved by combining these means.

In this embodiment, the image carrier squeezing roller 13Y is driven to rotate with the image carrier 10Y substantially at the same peripheral speed to collect the residual carrier C from the developer D consumed by the image carrier 10Y to develop the latent image by 5 to 10 wt % from the viewpoint of reducing the load of driving the two rollers and the effect of suppressing the turbulence of the visualized toner image that can be externally caused by the image carrier 10Y. The residual carrier C and the unnecessary fogging toner T" collected by the image carrier squeezing roller 13Y are collected from the image carrier squeezing roller 13Y by the cleaning effect of the cleaning blade 14Y.

The primary transfer section 50Y transfers the developed visible image on the image carrier 10Y onto the intermediate transfer body 40 by means of the primary transfer roller 51Y. The image carrier 10Y and the intermediate transfer body 40 are driven to move at the same speed at the surfaces thereof in order to reduce the load of driving them to rotate and move and also the effect of disturbing the visualized toner image that can be exerted by the image carrier 10Y. While no color mixing problem arises at the primary transfer section 10Y because yellow is the first color, a reverse transfer phenomenon where toner moves from the intermediate transfer body 40 to the image carriers 10(M, C, K) can appear as the second, the third and the fourth toner images are sequentially laid on the first toner image that is already put on the intermediate transfer body 40 by a primary transfer. Then, the reversely transferred toner and the toner remaining on the image carriers after the transfer are mixed with each other to give rise to color mixing and borne by the image carriers 10(M, C, K) to move before they are collected from the image carriers and pooled by the cleaning blades 17(M, C, K).

The intermediate transfer body squeezing apparatus 52Y is arranged downstream relative to the primary transfer section SOY to remove the residual carrier liquid from the intermediate transfer body 40 and raise the toner particle ratio in the visible image. It is arranged as means for further removing residual carrier liquid from the intermediate transfer body 40 when the carrier in the developer (with toner dispersed in the carrier) transferred onto the intermediate transfer body 40 at the primary transfer section 50Y does not get to about 40% to 60% by weight relative to the toner in a state where toner is dispersed in the liquid developer so that a desired secondary transfer effect and a desired fixing effect can be realized when the final image is transferred onto a sheet at the last stage of the developing step and moving to the fixing step (not shown). Like the image carrier squeezing apparatus, the intermediate transfer body squeezing apparatus 52Y includes an intermediate transfer body squeezing roller 53Y that is a resilient roller member having a resilient body 53-1Y formed on the surface and held in contact with the intermediate transfer body 40 to rotate, a backup roller 54Y arranged opposite to the intermediate transfer body squeezing roller 53Y with the intermediate transfer body 40 interposed between them, a cleaning blade 55Y pressed against the intermediate transfer body squeezing roller 53Y to slide thereon and clean the surface of the intermediate transfer body 40 and a developer reservoir 56Y. Intermediate transfer body squeezing apparatuses 52M, 52C and 52K have the same configuration as that of intermediate transfer body squeezing apparatus 52Y. As seen from FIG. 6, it has a function of collecting the residual carrier C and the intrinsically unnecessary fogging toner T" from the developer D consumed by the intermediate transfer body 40 for the primary transfer. The developer reservoir 56Y also operates as a mechanism for collecting the carrier liquid collected by the image carrier squeezing roller cleaning blade 14M for magenta that is arranged at the downstream side thereof.

The capacity of the intermediate transfer body squeezing apparatus for collecting residual carrier can be set to a desired level by selecting the rotational direction of the intermediate transfer body squeezing roller 53Y and the peripheral speed difference between the moving speed of the surface of the intermediate transfer body 40 and that of the peripheral surface of the intermediate transfer body squeezing roller 53Y. The collecting capacity is raised by driving the intermediate transfer body squeezing roller 53Y to rotate in the direction opposite to the rotational direction of the intermediate transfer body 40 and also by selecting a large peripheral speed difference. A synergetic effect can be achieved by combining these means. In this embodiment, the intermediate transfer body squeezing roller 53Y is driven to rotate with the intermediate transfer body 40 substantially at the same peripheral speed to collect the residual carrier and the fogging toner from the developer transferred to the intermediate transfer body 40 by the primary transfer by 5 to 10 wt % from the viewpoint of reducing the load of driving the two rollers and the effect of suppressing the turbulence of the toner image on the intermediate transfer body 40 that can be externally caused.

No color mixing problem arises at the intermediate transfer body squeezing site for yellow that is the first color because it is the first intermediate transfer body squeezing site. However, color mixing takes place with the second color as toner is moved from the intermediate transfer body 40 to the intermediate transfer body squeezing roller 53Y because an additional toner image is transferred onto the site of the toner image where a toner image has already been transferred so that different colors are laid one on the other. Then, the toner of the mixed colors is borne on the intermediate transfer body squeezing roller 53Y with the residual carrier and moved until it is collected from the intermediate transfer body squeezing roller 53Y and pooled by the corresponding cleaning blade. However, note that an intermediate transfer body squeezing apparatus may not necessarily be arranged downstream relative to each of the primary transfer processes when the squeezing capacity of the image carrier 10Y at the primary transfer site upstream relative to the site where the above-described intermediate transfer body squeezing process is conducted and the squeezing capacity of the image carrier squeezing roller 53Y are sufficiently large.

The image forming process of this embodiment adapted to use a liquid developer prepared by dispersing toner in a carrier is controlled so that the toner weight ratio (solid content ratio) of the developer prepared by dispersing toner by 20% in 80% of the carrier in terms of weight content ratio is about 45% for smooth paper such as coat paper, about 55% for ordinary paper and about 60% for rough paper showing coarse fiber filaments such as recycled paper when observed immediately before an image is transferred onto a sheet at the secondary transfer position after a variety of processing steps. The developer that is stored initially in the developer container 31Y is in a state where toner is dispersed to show a weight ratio of about 20% into a carrier. However, the toner consumption ratio is high when the image forming duty is high in the process of developing the latent image on the image carrier 10Y, whereas the toner consumption ratio is low when the image forming duty is low in the process. In other words, the weight content ratio of toner of the developer stored in the developer container 31Y changes incessantly as the latent image on the image carrier 10Y is developed so that it is necessary to constantly monitor the change and maintain and control the developer in a state where the toner is well dispersed to show a weight ratio of about 20%.

The control blade 33Y is held in contact with the anilox roller 32Y so as to leave the liquid developer in the grooves of the anilox pattern formed on the surface of the anilox roller 32Y to show projections and recesses and scrape off the excessive liquid developer. The liquid developer to be fed to the developing roller 20Y is controlled in this way. With this operation, the film thickness of the liquid developer applied to the developing roller 20Y is quantitatively controlled so as to make it equal to about 6 μm. The liquid developer scraped off by the control blade 33Y is forced to fall back into the developer container 31Y by gravity, whereas the liquid developer not scraped off by the control blade 33Y is held in the grooves of the projections and recesses of the surface of the anilox roller 32Y and subsequently applied to the surface of the developing roller 20Y as it is pressed against the developing roller 20Y.

The developing roller 20Y that is now bearing the liquid developer applied thereto by the anilox roller 32Y is held in contact with the toner compression roller 22Y at a position downstream relative to the nip section between the developing roller 20Y and the anilox roller 32Y. A predetermined bias voltage is applied to the developing roller 20Y while a bias voltage that is higher than the bias voltage applied to developing roller 20Y and shows a polarity same as that of the electric charge of the toner is applied to the toner compression roller 22Y. The application of the bias voltage will be described in greater detail hereinafter.

Due to the applied bias voltage, the toner particles in the liquid developer on the developing roller 20Y are agglomerated and driven to move toward the developing roller 20Y as the developing roller 20Y passes by the nip section between itself and the toner compression roller 22Y as shown in FIG. 3. Then, as a result, toner particles are mildly bonded to each other and agglomerated to show a filmy state. Thus, toner particles move swiftly from the developing roller 20Y to the image carrier 10Y in the developing process that is conducted on the image carrier 10Y to improve the image density.

The image carrier 10Y is made of amorphous silicon. After it is electrically charged by the charging roller 11Y at a position upstream relative to the nip section between itself and the developing roller 20Y, a latent image is formed on the surface thereof by the exposure unit 12Y. Toner particles T are selectively driven to move to the image area on the image carrier 10Y in the nip section formed between the developing roller 20Y and the image carrier 10Y as shown in FIG. 4 according to the bias voltage applied to the developing roller 20Y and the electric field produced on the latent image that is formed on the image carrier 10Y so that consequently a toner image is formed on the image carrier 10Y. Additionally, since the carrier liquid C that is carrying toner is not influenced by the electric field, it is separated from the toner at the exit of the developing nip section between the developing roller 20Y and the image carrier 10Y and adheres to both of the developing roller 20Y and the image carrier 10Y as shown in FIG. 4. After passing by the developing nip section, the image carrier 10Y then passes by the image carrier squeezing roller 13Y, where the residual carrier liquid C is removed as shown in FIG. 5 and the formed toner image is subjected to a process for raising the content ratio of toner particles in the visible image.

Then, the image carrier 10Y passes by the nip section between itself and the intermediate transfer body 40 in the primary transfer section 50Y and the visible toner image is transferred to the intermediate transfer body 40. More specifically, the toner on the image carrier 10Y is transferred onto the intermediate transfer body 40 as a bias voltage showing a polarity opposite to the charging characteristics of the toner particles is applied to the primary transfer roller 51Y so that consequently only carrier liquid is left on the image carrier 10Y. After the primary transfer, the electrostatic latent image is erased from the image carrier 10Y by means of a latent image eraser 16Y, which is typically includes a lamp, at a position downstream relative to the primary transfer section in the rotational direction of the image carrier 10Y and the carrier liquid left on the image carrier 10Y is scraped off by the image carrier cleaning blade 17Y and collected in the developer reservoir 18Y.

The toner image transferred onto the intermediate transfer body 40 as a result of the primary transfer operation in the primary transfer section 50Y is then made to pass by the intermediate transfer body squeezing roller 52Y by which the residual carrier on the intermediate transfer body 40 is scraped off. A predetermined bias voltage is applied to the intermediate transfer body squeezing roller 53Y and also to the intermediate transfer body squeezing backup roller 54Y of the intermediate transfer body squeezing apparatus 52Y to generate an electric field that pushes toner particles toward the intermediate transfer body 40. Thus, as shown in FIG. 6, no toner particles are collected by the intermediate transfer body squeezing roller 53Y but carrier liquid that is not influenced by any electric field is separated from toner particles in an area between the intermediate transfer body 40 and intermediate transfer body squeezing roller 53Y and collected by the latter.

The toner image on the intermediate transfer body 40 proceeds to the secondary transfer unit 60 and enters the nip section between the intermediate transfer body 40 and the secondary transfer roller 61. The width of the nip section is defined to be equal to 3 mm. A predetermined bias voltage is applied to the secondary transfer roller 61 and the belt drive roller 41 in the secondary transfer unit 60 to cause the toner image on the intermediate transfer body 40 to be transferred onto a recording medium which may typically be a sheet of paper.

After passing through the secondary transfer unit 60, the intermediate transfer body 40 to the winding contact area of the tension roller 42 and the surface of the intermediate transfer body 40 is cleaned by the intermediate transfer body cleaning blade 46 before the intermediate transfer body 40 returns to the primary transfer sections 50.

Now, the squeezing function of the secondary transfer roller 61 will be described below. A sheet, or a recording medium, is supplied synchronously at the time when the multi-color toner image on the intermediate transfer body 40 arrives at the secondary transfer site and the toner image is transferred onto the sheet in a secondary transfer operation. Then, the sheet is fed to a fixing process (not shown) to end the operation of forming an image on the sheet. However, if a trouble such as a jam arises on the sheet being fed, the toner image is transferred from the intermediate transfer body 40 onto the secondary transfer roller 61 because no sheet is there. Then, the rear surface of the sheet that arrives thereafter is smeared by the toner on the secondary transfer roller 61. The secondary transfer roller 61 of this embodiment is a resilient roller having a resilient member arranged on the surface. Note that the intermediate transfer body 40 is a resilient belt selected to improve the secondary transfer performance, following the surface profile of the sheet onto which a toner image is to be transferred if the surface of the sheet is fibrous and not very smooth and the multi-color toner image is produced by sequentially laying a plurality of monochromatic toner images formed on the photosensitive bodies one on the other. A resilient roller is selected for the secondary transfer roller 61 exactly for the same reason. The secondary transfer roller cleaning blade 62 is provided as means for removing the developer (containing toner particles dispersed in carrier) transferred onto the secondary transfer roller 61 and collects the developer from the secondary transfer roller 61 so as to pool it. The pooled developer shows a mixture of colors and can contain foreign objects such as paper powder.

Now, the cleaning apparatus of the intermediate transfer body 40 will be described below. When a trouble such as a jam takes place to the sheet being fed, not all the toner image may not be transferred onto the secondary transfer roller 61 but part of the toner image can be left on the intermediate transfer body 40. When the secondary transfer process is conducted properly, the toner image on the intermediate transfer body 40 may not be transferred onto a sheet by 100 percents but partly left on the intermediate transfer body 40 probably by several percents. The unnecessary toner of the toner image of either type that is left on the intermediate transfer body 40 is scraped off and collected by the intermediate transfer body cleaning blade 46 and pooled in the developer reservoir 47 arranged downstream in moving direction of the intermediate transfer body 40 for the next image forming operation.

Now, transmission of drive force in the developing units 30Y, 30M, 30C, 30K, where rotary body drive transmission mechanisms are employed for this embodiment, will be described in detail below. For the purpose of the present invention, rotary body drive transmission mechanisms are employed to transmit rotary drive force from the image forming apparatus main body respectively to the image carriers and the rollers of the developing units 30Y, 30M, 30C, 30K that are removably mounted in the image forming apparatus main body.

Figure 8:
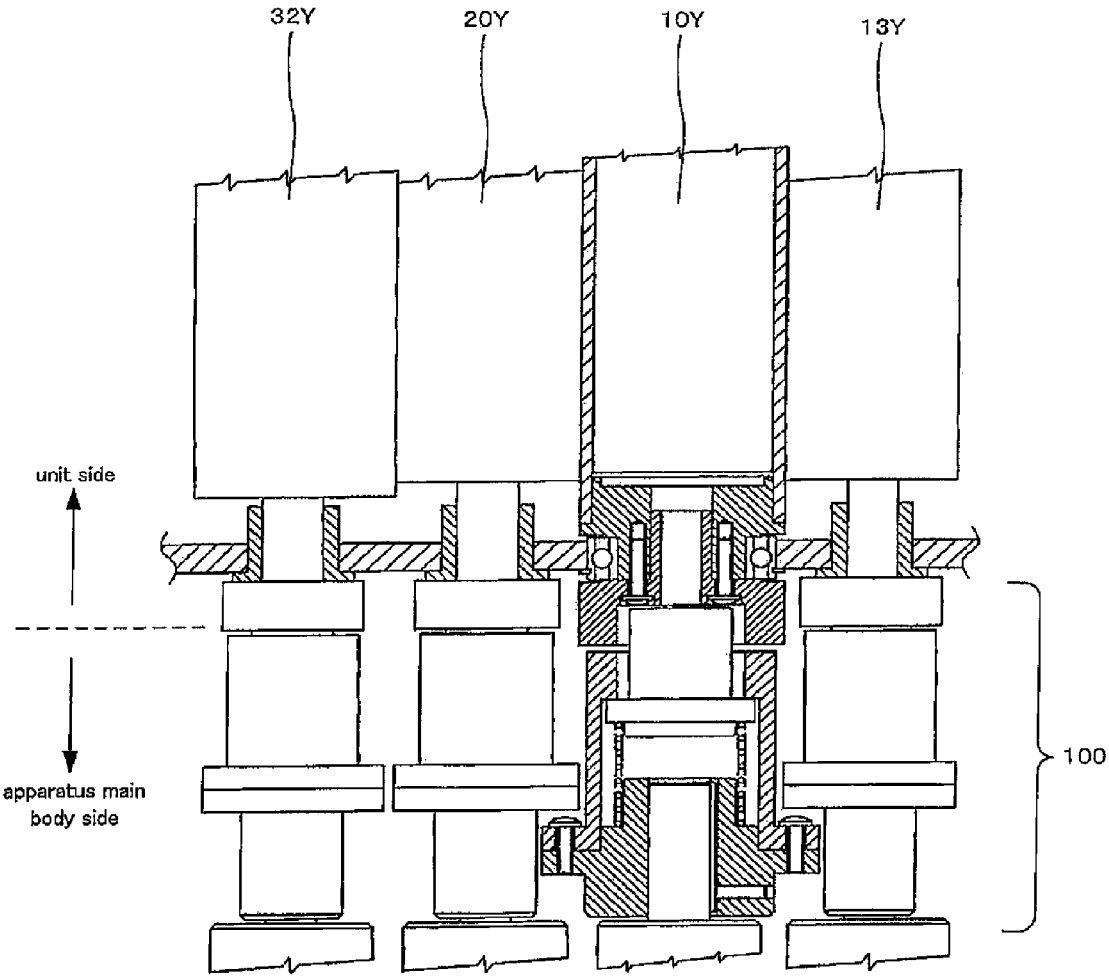
FIG. 8 is a schematic illustration of a rotary body drive transmission mechanism being operated for a development unit.

FIG. 8 is a schematic illustration of the rotary body drive transmission mechanisms being operated for the development units.

Figure 9:
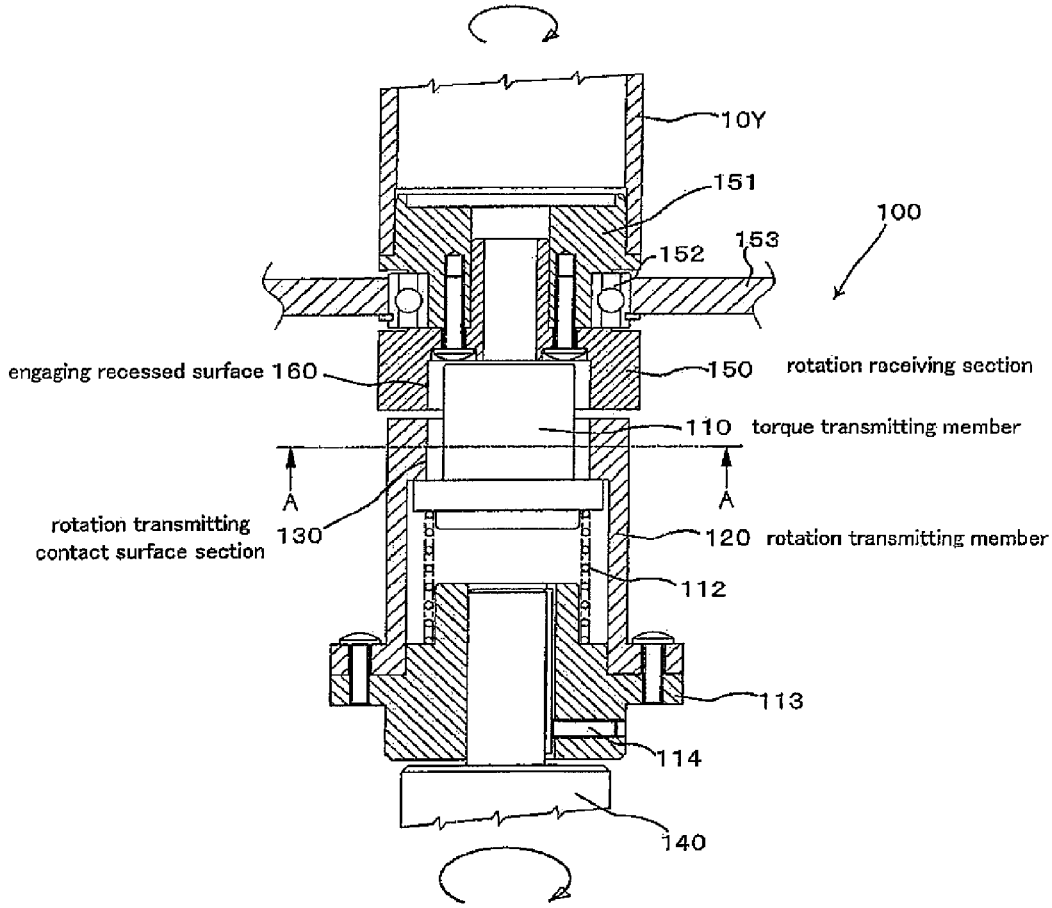
FIG. 9 is a schematic cross-sectional view of a rotary body drive transmission mechanism in a coupling operation.
Figure 10:
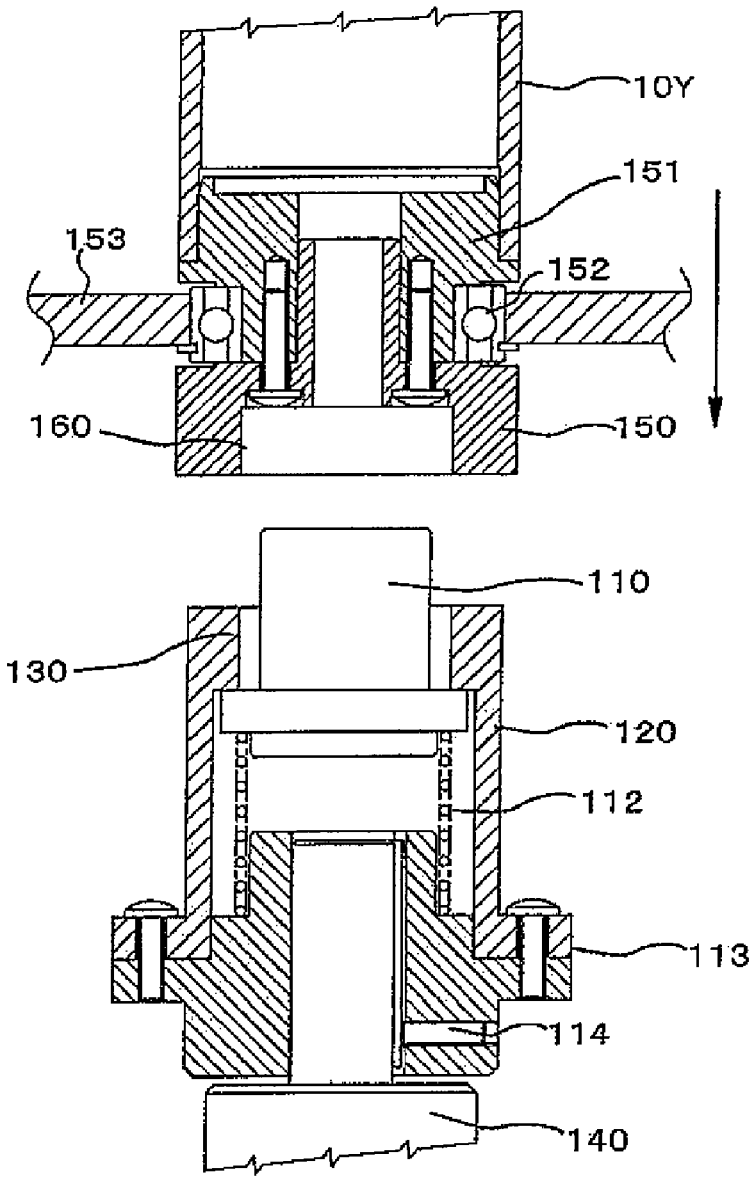
FIG. 10 is a schematic cross-sectional view of a rotary body drive transmission mechanism before a coupling operation.
Figure 11:
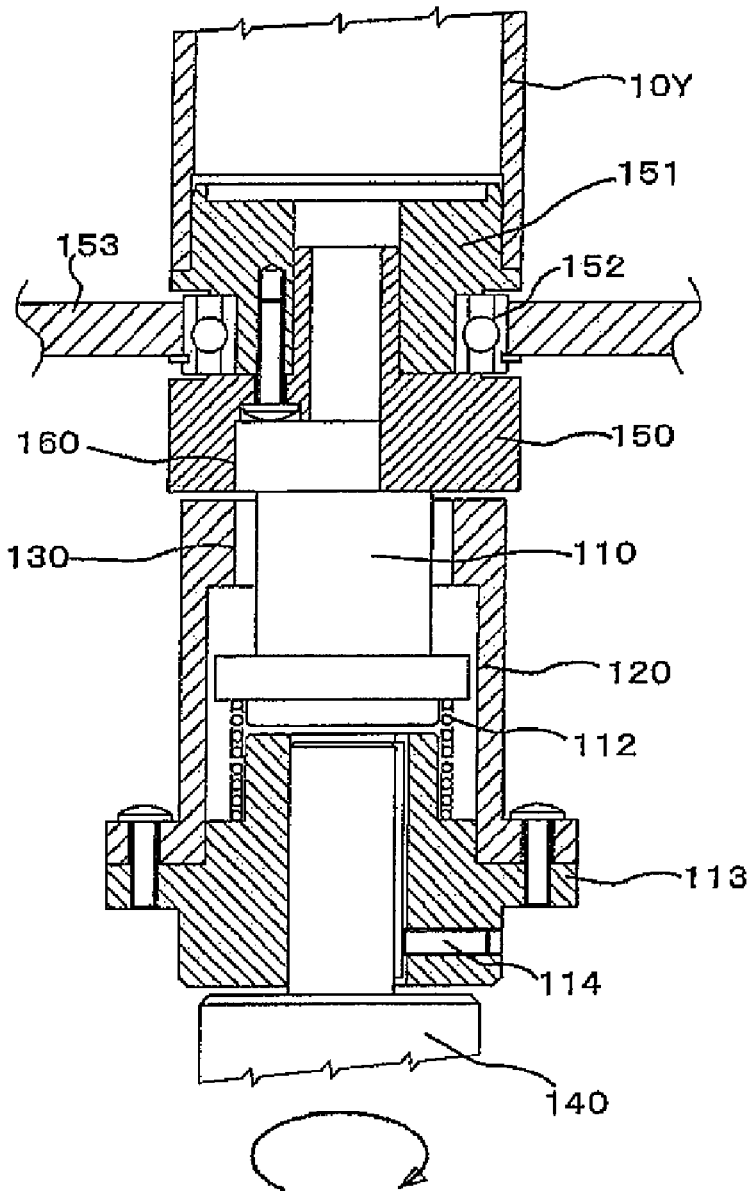
FIG. 11 is a schematic cross-sectional view of a rotary body drive transmission mechanism before the related members are completely engaged with each other.

FIG. 9 is a schematic cross-sectional view of one of the rotary body drive transmission mechanisms in a coupling operation. FIG. 10 is a schematic cross-sectional view of the rotary body drive transmission mechanism of FIG. 9 before a coupling operation. FIG. 11 is a schematic cross-sectional view of the rotary body drive transmission mechanism of FIG. 9 before the related members are completely engaged with each other.

In FIG. 8, 100 denotes the rotary body drive transmission mechanisms. In this embodiment, one of the rotary body drive transmission mechanisms 100 is employed to transmit rotary drive force to the image carrier 10Y, the image carrier squeezing roller 13Y, the developing roller 20Y and the anilox roller 32Y. While the rotary body drive transmission mechanism 100 is employed for the above listed rollers in this embodiment, it may alternatively be so arranged that the rotary body drive transmission mechanism 100 is employed for only one of the rollers or a combination of any of them. Still alternatively, the rotary body drive transmission mechanism 100 may be employed for one or more rollers other than or in addition to the above listed rollers. While rotary body drive transmission mechanisms are applied to an image forming apparatus adapted to use liquid developer in this embodiment, they may alternatively be applied to an image forming apparatus adapted to use dry toner.

In FIGS. 9 through 11, 110 and 120 respectively denote a torque transmitting member and a rotation transmitting member and 112, 113 and 114 respectively denote a spring member, a flange section and a key member, whereas 130, 140 and 150 respectively denote a contact surface section for transmission, a rotary body drive source and a rotation receiving member, whereas 151, 152 and 153 respectively denote a rotary body fitting flange section, a ball bearing and a support member. Reference symbol 160 denotes an engaging recessed surface.

FIGS. 9 through 11 show a structure, which include a rotation transmitting member 120 and other members in the rotary body drive transmission mechanism 100, for transmitting drive force from the rotating rotary body drive source 140 to drive a rotatably supported rotary body (image carrier 10Y) to rotate around the rotary axis of the rotary body.

While FIGS. 9 through 11 illustrate an arrangement where the rotary body, which is the image carrier 10Y, receives drive force for driving it to rotate from the rotary body drive source 140, which is typically a motor, a similar arrangement can be used when the rotary body represents one or more of the image carrier squeezing roller 13Y, the developing roller 20Y, anilox roller 32Y and other rollers, that receive drive force for driving them to rotate.

The rotary drive force is transmitted from the key member 114 of the rotary body drive source by way of the drive flange section 113 fixed to the key member 114.

The rotation transmitting member 120 has a polygonal hole cut through it to produce an inner wall surface that operates as contact surface section for transmission 130 for transmitting rotary force to the torque transmitting member 110. The torque transmitting member 110 is urged by the spring member 112 to project from the polygonal hole of the rotation transmitting member 120. The rotation receiving member 150 also has a polygonal hole cut into it to receive rotary force by way of the torque transmitting member 110. The inner wall surface thereof that operates as engaging recessed surface 160 is engaged with the torque transmitting member 110.

The rotation receiving member 150 is rigidly secured to the rotary body fitting flange section 151 by a predetermined fitting means and the rotary body (image carrier 10Y) fitted to the rotary body fitting flange section 151 is driven to rotate with the rotation receiving member 150. The rotary body fitting flange section 151 is fitted to the support member 153 by way of a ball bearing so that it can rotate freely.

FIG. 10 is a schematic cross-sectional view of the rotary body drive transmission mechanism where the rotation receiving member 150 is about to be mounted on the rotation transmitting member 120 in the direction indicated by an arrow. In FIG. 10, the torque transmitting member 110 that is loosely engaged with the rotation transmitting member 120 is totally free from any restriction.

FIG. 11 is a similar schematic cross-sectional view of the rotary body drive transmission mechanism where the rotation receiving member 150 is mounted on the rotation transmitting member 120 at a predetermined position. In FIG. 11, the torque transmitting member 110 that is loosely engaged with the rotation transmitting member 120 but the polygonal profile of the torque transmitting member 110 is not aligned and out of phase with the plurality of contact surfaces formed on the torque transmitting member 110. Under this condition, the end facet of the rotation receiving member 150 and the corresponding end facet of the oppositely disposed torque transmitting member 110 are brought into contact with each other and the torque transmitting member 110 is moved against the pressure of the spring member 112.

Figure 12:
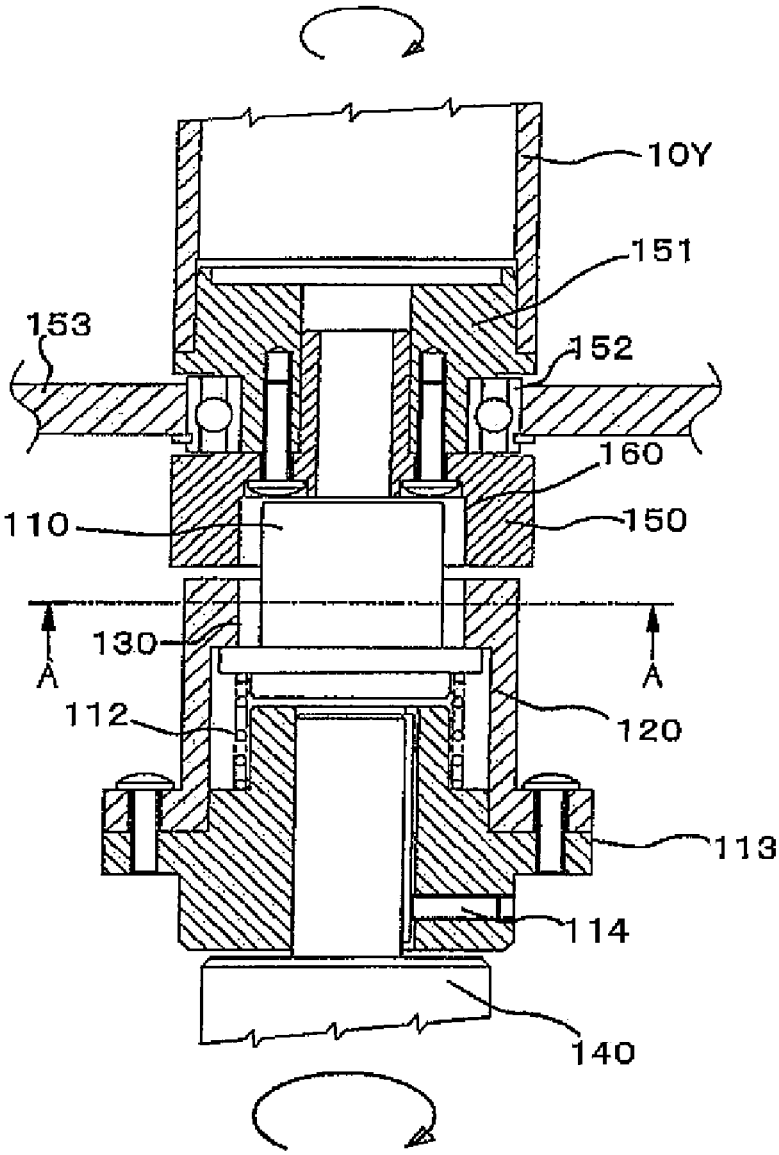
FIG. 12 is a schematic cross-sectional view of a rotary body drive transmission mechanism in a coupling operation.

FIG. 12 is also a similar schematic cross-sectional view of the rotary body drive transmission mechanism where the torque transmitting member 110 that is loosely engaged with the rotation transmitting member 120 is driven to rotate by the rotation transmitting member 120 until it becomes aligned and arranged in phase with the engaging recessed surface 160 formed in the rotation receiving member 150 and engaged with the rotation receiving member 150 under the pressure applied by the spring member 112.

The engaging recessed surface 160 in the hole of the rotation receiving member 150 is preferably provided with a predetermined clearance relative to the torque transmitting member 110 in the rotational direction and also a predetermined clearance running orthogonal relative to the axis of rotation of the torque transmitting member 110. As for the loose relationship between the torque transmitting member 110 and the rotation receiving member 150 and the rotation transmitting member 120, the clearance for allowing the torque transmitting member 110 to rotate may be such that, while the rotation transmitting member 120 is driving the rotary body (image carrier 10Y) to rotate, the torque transmitting member 110 may move and enter the urging side as it is rotating.

The rotation receiving member 150 is rotatably supported by the ball bearing 152 that is by turn supported by the rotary body fitting flange section 151 that is press-fitted into an end of the cylindrical rotary body (image carrier 10Y) and rigidly secured to the rotary body fitting flange section 151 by means of a screw to define its axial position.

On the other hand, the rotary body drive source 140, which is not shown in detail, is arranged opposite to the rotary body (image carrier 10Y) in the direction of the axis of rotation of the rotary body and the rotary motion of the rotary body drive source 140 is transmitted to the drive flange section 113 by way of the key member 114. The rotation transmitting member 120 is mounted on the drive flange section 113 to form the rotary body drive transmission mechanism with the rotation receiving member 150 arranged opposite to it.

The rotary body drive transmission mechanism includes the polygonal pillar-shaped torque transmitting member 110 extended from the rotary body (image carrier 10Y) in the direction of the axis of rotation thereof and the rotation receiving member 150 is provided with a polygonal hole corresponding to the polygonal profile of the torque transmitting member 110 and presenting a plurality of abut surfaces (engaging recessed surface 160) to be brought into contact with the lateral surfaces of the torque transmitting member 110 with a predetermined clearance relative to the torque transmitting member 110 in the rotational direction and also a predetermined clearance running orthogonal relative to the axis of rotation of the torque transmitting member 110.

Now, the relationship of the polygonal profile of the torque transmitting member 110 and polygonal hole cut into the rotation transmitting member 120 and the polygonal hole cut into the rotation receiving member 150 and the transmission of rotary drive force of the rotary body drive transmission mechanism will be described below.

FIGS. 13A through 13D are detailed schematic illustrations of the relationship of the polygonal profile of the torque transmitting member 110 and the rotation receiving member 150 and the revolution transmitting member 120. They are taken along line A-A in FIG. 12.

In FIGS. 13A through 13D, none of the lateral surfaces of the polygonal torque transmitting member 110, the abut surfaces of the rotation receiving member and those of the rotation transmitting member run in parallel.

Figure 13A:
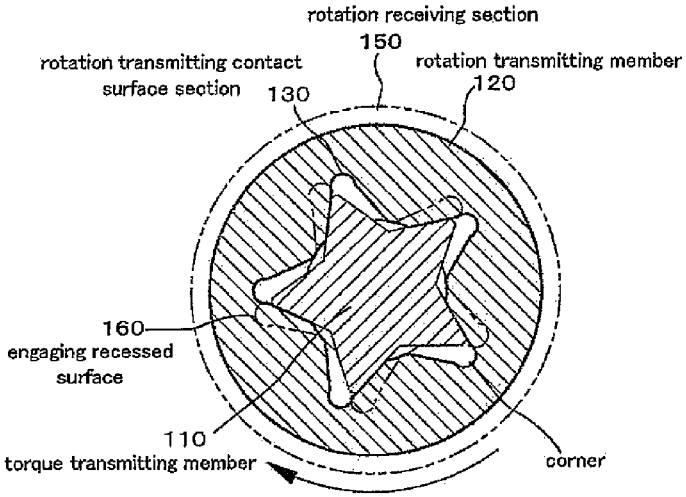
FIGS. 13A through 13D are detailed schematic illustrations of the relationship of the polygonal profile of the torque transmitting member and the rotation receiving member and the revolution transmitting member.

FIGS. 13A through 13D schematically illustrate the relationship of the polygonal profile of the torque transmitting member 110 and the abut surfaces of the rotation receiving member 150 and those of the rotation transmitting member 120, the number of the abut surfaces of each of the member being an odd number. FIG. 13A schematically shows how the rotation receiving member 150 is driven to rotate by the rotation transmitting member 120 by way of the torque transmitting member 110. Although FIG. 13A is not an accurate cross section taken along line A-A, the rotation receiving member 150 is indicated by a doubly dotted chain line for the sake of clearness of illustration.

Figure 13B:
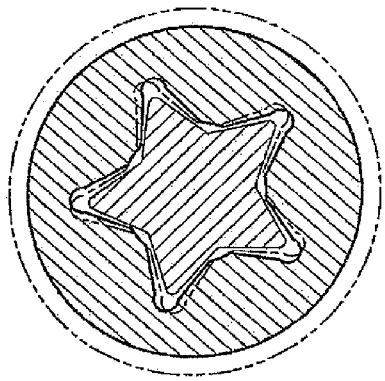

FIG. 13B schematically shows the torque transmitting member 110, the rotation receiving member 150 and the rotation transmitting member 120 when none of them is driven to rotate. The torque transmitting member 110 is loosely engaged with the rotation receiving member 150 and the rotation transmitting member 120 with a predetermined clearance in the rotational direction of the torque transmitting member 110 and also a predetermined clearance running orthogonal relative to the axis of rotation of the torque transmitting member 110. In FIGS. 13A and 13B, the polygonal profile of the torque transmitting member 110, the profile of the abut surfaces of the rotation receiving member 150 and that of the abut surfaces of the rotation transmitting member 120 are pentagonal.

Figure 13C:
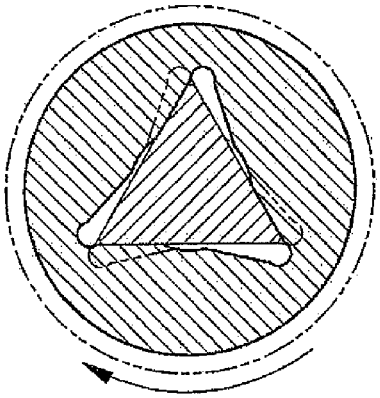
Figure 13D:
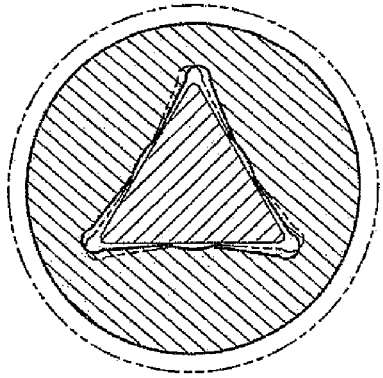

In FIGS. 13C and 13D, the polygonal profile of the torque transmitting member 110, the profile of the abut surfaces of the rotation receiving member 150 and that of the abut surfaces of the rotation transmitting member 120 are triangular.

The polygonal profile of the torque transmitting member 110, the profile of the abut surfaces of the rotation receiving member 150 and that of the abut surfaces of the rotation transmitting member 120 are differentiated in each of FIGS. 13A through 13D but what is common to all of them is that, when none of the torque transmitting member 110, the rotation receiving member 150 and the rotation transmitting member 120 is driven to rotate, the torque transmitting member 110 is loosely engaged with the rotation receiving member 150 and the rotation transmitting member 120 with a predetermined clearance in the rotational direction of the torque transmitting member 110 and also a predetermined clearance running orthogonal relative to the axis of rotation of the torque transmitting member 110.

As the rotation transmitting member 120 is driven to rotate in the direction of the arrows in FIGS. 13A and 13C to by turn drive the rotation receiving member 150 by way of the torque transmitting member 110, the abut surfaces of the rotation transmitting member 120 are brought into contact with the torque transmitting member 110 and then the torque transmitting member 110 is brought into contact with the abut surfaces of the rotation receiving member 150 so that the latter is driven to rotate.

When the rotation receiving member 150 and the rotation transmitting member 120 are driven to rotate, the torque transmitting member 110 that is loosely engaged with the abut surfaces of the rotation receiving member 150 and those of the rotation transmitting member 120 automatically moves to a desired position where it stabilizes itself from the loosely engaged state and automatically adjusts the position of its axis of rotation.

Thus, the above-described embodiment can prevent the problem of fluctuations of rotation of known comparable apparatus due to the use of a single rotation transmitting site from arising without requiring a highly accurate positional arrangement of the related members.

On the other hand, if the lateral surfaces of the polygonal torque transmitting member 110, the abut surfaces of the rotation receiving member 150 and those of the rotation transmitting member 120 include those that run in parallel and the state of being driven to rotate of the abut surfaces of the rotation receiving member 150 and those of the rotation transmitting member 120 including a plurality of abut surfaces that run in parallel are viewed microcosmically, the torque transmitting member 110 that has moved from a loosely engaged state to a desired position where it stabilizes itself and automatically adjusted the position of its axis of rotation can inevitable move, if slightly, along the parallel abut surfaces to fall into an unstable state typically under the influence of delicate fluctuations of the transmission torque and external turbulences such as vibrations. Such a behavior of the torque transmitting member 110 can produce fluctuations, if small, in the rotary speed within the period of a single revolution.

When an odd number is selected for the number of the lateral surfaces of the polygonal torque transmitting member 110, the number of abut surfaces of the rotation receiving member 150 and that of abut surfaces of the rotation transmitting member 120, none of the plurality of abut surfaces of the rotation receiving member 150 runs in parallel with any of the plurality of abut surfaces of the rotation transmitting member 120. Thus, the state of being driven to rotate the abut surfaces of the rotation receiving member 150 and those of the rotation transmitting member 120 are viewed microcosmically, the torque transmitting member 110 that has moved from a loosely engaged state to a desired position where it stabilizes itself and automatically adjusted the position of its axis of rotation cannot move along the parallel abut surfaces to fall into an unstable state and hence maintains the automatically adjusted position of its axis of rotation under the influence of delicate fluctuations of the transmission torque and external turbulences such as vibrations. Therefore, it does not produce fluctuations, if small, in the rotary speed within the period of a single revolution.

The polygonal profile of the torque transmitting member 110, the profile of the abut surfaces of the rotation receiving member 150 and that of the abut surfaces of the rotation transmitting member 120 are most preferably triangular from the viewpoint of manufacturing because the triangle is the most simple form of polygon.

In each of FIGS. 13A through 13D showing the polygonal profile of the torque transmitting member 110, the profile of the abut surfaces of the rotation receiving member 150 and that of the abut surfaces of the rotation transmitting member 120, the polygonal profile of the torque transmitting member 110 same and common to both the rotation receiving member 150 and the rotation transmitting member 120. However, the profile of the torque transmitting member 110 may be differentiated between that of the part thereof loosely engaged with the rotation receiving member 150 and that of the part thereof loosely engaged with the rotation transmitting member 120. While the torque transmitting member 110 is loosely engaged with and contained in the rotation receiving member 150 and the rotation transmitting member 120 in each of FIGS. 13A through 13D, it may alternatively be made to contain the rotation receiving member 150 and the rotation transmitting member 120.

While the torque transmitting member 110 is urged to move in a direction by means of a spring to stabilize the axial position thereof in addition to the effect of automatically adjusting the position of its axis of rotation, the provision of a spring is not an indispensable requirement.

Now, an arrangement where a rotary body drive transmission mechanism is applied to a plurality of rollers in an image forming apparatus according to the present invention will be discussed below. While the rotary body drive transmission mechanism 100 is employed to transmit rotary drive force to the image carrier 10Y, the image carrier squeezing roller 13Y, the developing roller 20Y and the anilox roller 32Y, the corners of the polygon of the profile of the engaging recessed surface 160 of the rotation receiving member 150 that corresponds to the rollers are preferably not in parallel with each other. This is because the image can be disturbed by resonating noise if there is a position where the corners are in parallel and in phase with each other in any of the rollers. The corners refer to the apexes of the polygons including the polygon of the engaging recessed surface 160.

When the rotary body drive transmission mechanism 100 is applied to the image carrier 10Y and the anilox roller 32Y, the corners of the polygons are preferably so defined as not to be in parallel with each other. This is because the number of revolutions per unit time of the anilox roller 32Y needs to be changed delicately according to the quality of the sheet of paper being used, the room temperature and other factors and particularly because the image carrier 10Y is preferably prevented from being interlocked.

Figure 14A:
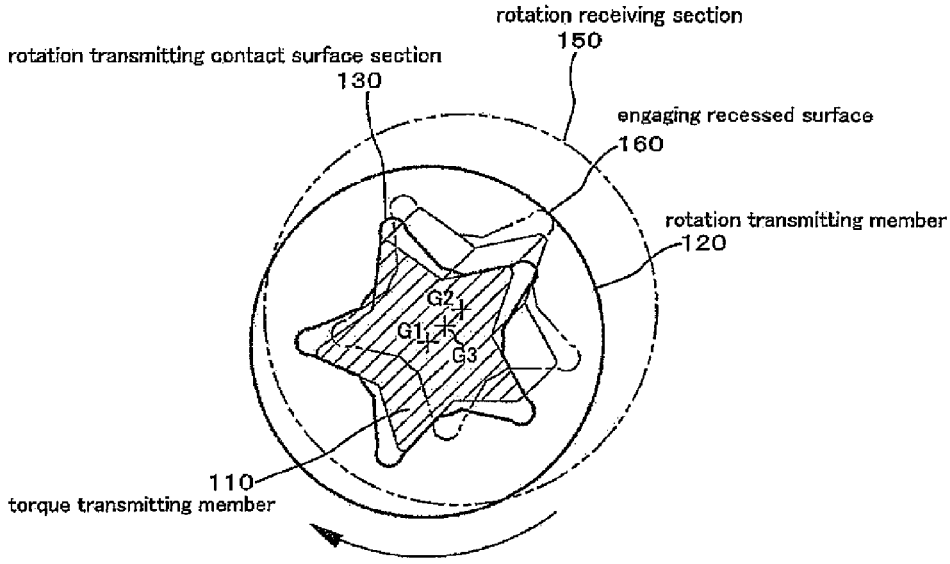
FIGS. 14A and 14B are detailed schematic illustrations of the relationship of the polygonal profile of the torque transmitting member and the rotation receiving member and the revolution transmitting member.
Figure 14B:
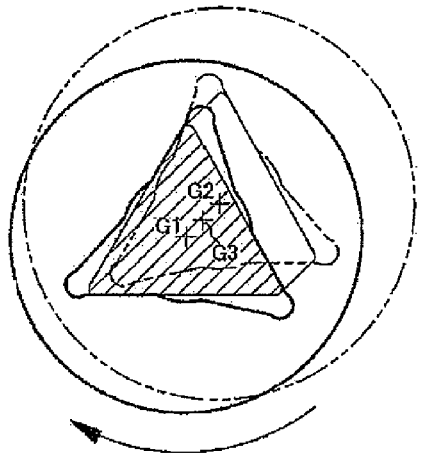

FIGS. 14A and 14B are detailed schematic illustrations of the relationship of the polygonal profile of the torque transmitting member 100 and the rotation receiving member 150 and the rotation transmitting member 120. They show arrangements same as those described above by referring to FIGS. 13A through 13D. FIGS. 14A and 14B differ from FIGS. 13A through 13D in that they exaggeratedly show that the axis of rotation of the rotation receiving member 150 and that of the rotation transmitting member 120 are displaced from each other. However, a non-rotating state is not shown. Although FIGS. 14A and 14B are not accurate cross sections taken along line A-A in FIG. 12, the rotation transmitting member 120 is not hatched and the rotation receiving member 150 is indicated by a two-dot chain line for the sake of clearness of illustration. In FIGS. 14A and 14B, G1 denotes the axis of rotation of the rotation transmitting member 120 and G2 denotes the axis of rotation of the rotation receiving member 150, whereas G3 denotes the imaginary axis of rotation of the entire rotary body drive transmission mechanism.

In FIGS. 14A and 14B, the axis of rotation of the rotation transmitting member 120 and that of the rotation receiving member 150 are displaced from each other. The torque transmitting member 110 automatically shifts the axis of rotation according to the rotation transmitting member 120 at a side thereof but according to the above-described mechanism at the other side in order to move its axis of rotation to a position that is desirable to stabilize itself.

More specifically, the torque transmitting member 110 transmits rotary drive force from the rotation transmitting member 120 to the rotation receiving member 150 in a state where it is inclined to an extent that corresponds to the mutual displacement of the axes of rotation of the rotation transmitting member 120 and the rotation receiving member 150. Under this condition, the imaginary axis of rotation G3 of the torque transmitting member 110 is located at the middle position of the mutual displacement, or the position corresponding to ½ of the mutual displacement, to transmit rotary drive force.

The rotary speed of the period of a single revolution is changed according to the mutual displacement of the axis of rotation of the driving side and the axis of rotation of the driven side in any comparable known arrangement. However, with the above-described arrangement of this embodiment, the change in the rotary speed of the period of a single revolution can be reduced to a half because the imaginary axis of rotation G3 of the torque transmitting member 110 is located at the middle position of the mutual displacement, or the position corresponding to ½ of the mutual displacement, to transmit rotary drive force.

Thus, although the above-described arrangement of rotary body drive transmission mechanism is simple, it can prevent the problem of fluctuations of rotation from arising without requiring a highly accurate positional arrangement of the related members. Additionally, a rotary body drive transmission mechanism as described above can prevent changes in the rotary speed of the period of a single revolution attributable to the mutual displacement of the axis of rotation of the driving side and the axis of rotation of the driven side.

Still additionally, the above-described arrangement can prevent products from being rejected if they involve dimensional errors to a certain extent to improve the manufacturing yield on a large scale of mass production.

Furthermore, an image forming apparatus comprising rotary body drive transmission mechanisms having the above-described configuration does not give rise to occurrence of jitters in the period of a single revolution of the rotary body drive transmission mechanism to give rise to disturbed or unstable images.

Now, the developer conveying apparatus of this embodiment that is employed for the developer reservoir 18Y of the image carrier 11Y and the developer conveying apparatus of this embodiment that is employed for the developer reservoir 24Y of the developing roller 20Y of the image forming apparatus will be described below.

Figure 15:
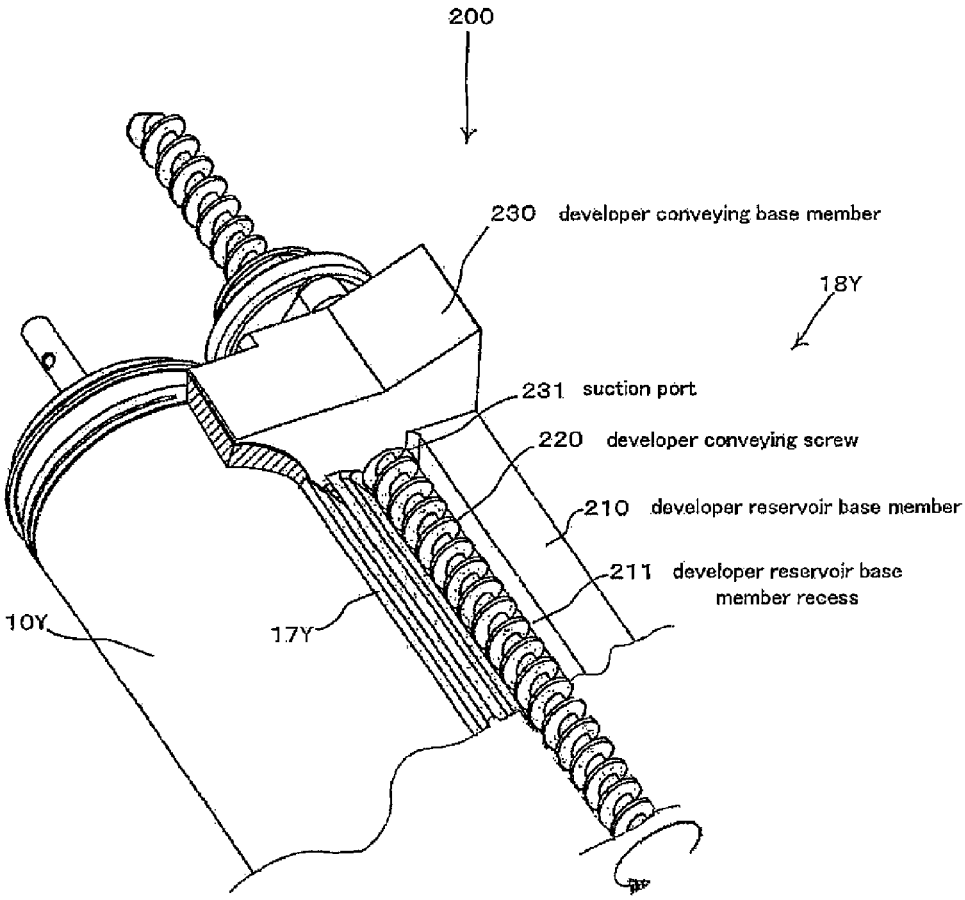
FIG. 15 is a schematic perspective view of the developer conveying apparatus of the developer reservoir 18Y.
Figure 16:
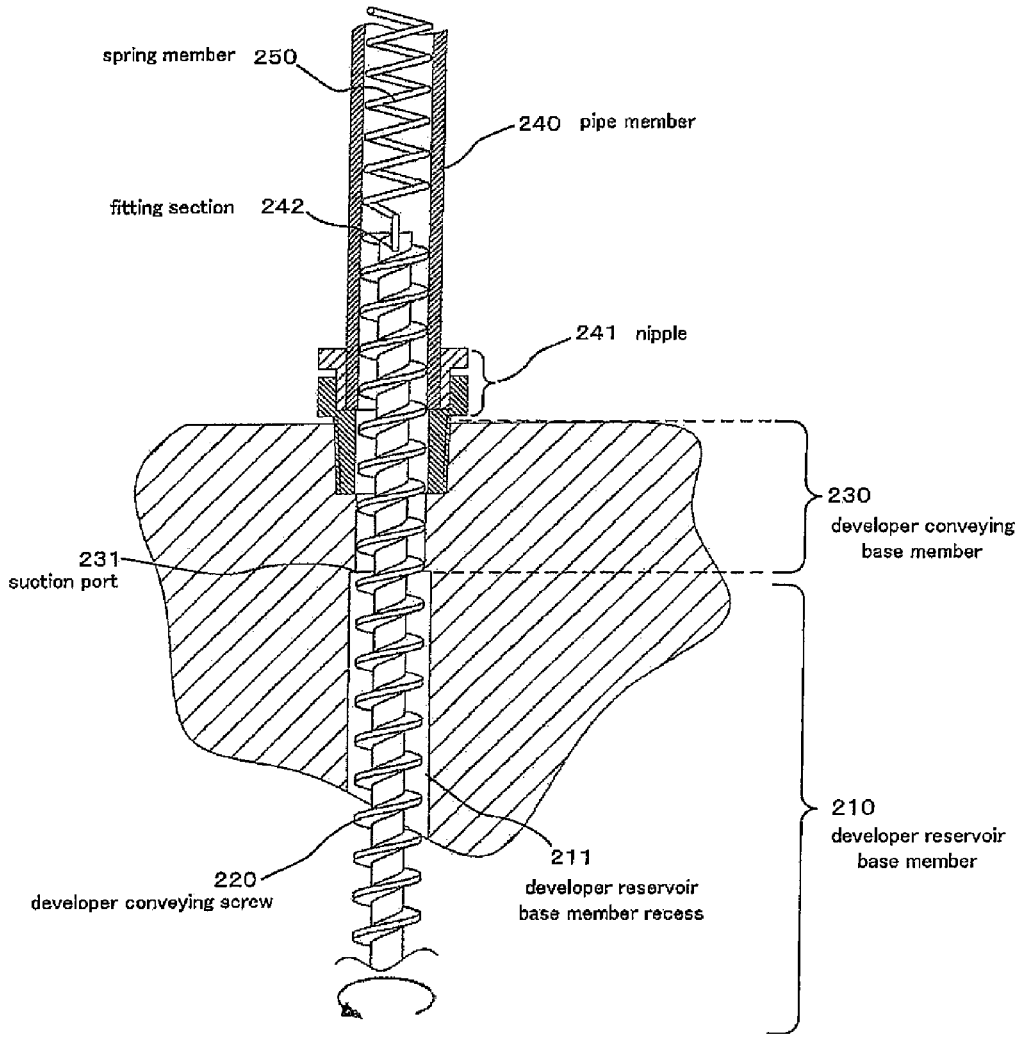
FIG. 16 is a schematic cross-sectional view of a principal part of the embodiment of developer conveying apparatus.

FIG. 15 is a schematic perspective view of the developer conveying apparatus of the developer reservoir 18Y. FIG. 16 is a schematic cross-sectional view of a principal part of the embodiment of developer conveying apparatus. Note that FIG. 16 is a cross-sectional view taken along line B-B in FIG. 2. Also note that the developer conveying apparatus employed for the developer reservoir 24Y has a substantially same configuration.

In FIGS. 15 and 16, 200 denotes the developer conveying apparatus and 210, 211, 220 respectively denotes a developer reservoir base member, a developer reservoir base member recess and a developer conveying screw, whereas 230, 231 and 240 respectively denotes a developer conveying base member, a suction port and a pipe member and 241, 242 and 250 respectively denotes a nipple, a fitting section and a spring member.

As shown in FIG. 2, after transferring the developer from the image carrier 10Y to the intermediate transfer body 40 for primary transfer, the remaining developer left on the image carrier 10Y is scraped off by the image carrier cleaning blade 17Y and stored in the developer reservoir 18Y. More specifically, it is temporarily stored in the developer reservoir base member 210 of the developer conveying apparatus 200 that is incorporated into the developer reservoir 18Y and then conveyed from the developer reservoir base member 210 to the developer conveying base member 230 arranged at a longitudinal end of the developer reservoir base member 210.

The developer conveying screw 220 is formed by arranging a spiral blade showing a predetermined winding pitch on the outer periphery of a cylindrical base member and disposed in the developer reservoir base member recess 211 of the developer reservoir base member 210 so that the cylindrical base member and the spiral blade are driven to rotate integrally in order to convey developer in an axial direction. The developer reservoir base member recess 211 has a profile adapted to cover the developer conveying screw 220 and the radius of curvature thereof is so defined as to be slightly larger than the radius of the suction port 231.

The developer reservoir 18Y includes a developer reservoir base member recess 211 that shows a subsequently U-shaded longitudinal cross section with an open upper end so as to be adapted to store the developer scraped off from the image carrier 10Y and discharges developer from an end of the developer reservoir base member 210 in an axial direction. The circular suction port 231 is formed on the developer conveying base member 230 arranged at an end of the developer reservoir base member 210. The developer conveying screw 220 is introduced into the suction port 231 and driven to rotate. The diameter of the suction port 231 is such that it allows the developer conveying screw 220 to move through it with a small margin. The developer conveying screw 220 extends from the inside of the developer reservoir base member recess 210 to the inside of the suction port 231 of the developer conveying base member 230 to realize a remarkable pumping effect of pumping developer to the suction port 231.

The developer conveying screw 220 is driven to rotate and conveys developer under the condition where the top end of the developer reservoir base member 210 is opened. The pumping effect of the developer developing screw 220 is terminated when the developer being conveyed appears at the top end of the developer conveying screw 220 introduced into the suction port 231. Then, the developer is conveyed further from there to a desired position under pressure.

The developer conveying base member 230 is provided with a hole that is held in communication with the suction port 231 and the pipe member 240 is fitted to the hole by means of the nipple 241. The developer conveying screw 220 extends into the pipe member 240 and the spring member 250 is arranged in the pipe member 240 and fitted to the developer conveying screw 220 by means of the fitting section 242 such that the outer periphery of the spring member 250 slides on the inner wall of the pipe member 240. On the other hand, the developer stored in the developer reservoir 18Y shown in FIG. 2 is the developer scraped off from the image carrier and hence it is electrically charged. In other words, toner particles in the developer are apt to agglomerate and become electrostatically adsorbed to other members. Thus, toner particles can highly probably be adsorbed to the inner surface of the developer conveying route when developer is fed under pressure by the above-described pumping effect.

Therefore, a spring member 250 formed with a predetermined winding pitch is mounted to and supported by the projecting end of the developer conveying screw 220 so as to be able to rotate integrally with the developer conveying screw 220 in this embodiment. A small clearance is provided between the outer periphery of the spring member 250 and the inner surface of the developer discharge port so that, if toner particles are electrostatically adsorbed to the inner surface of the developer conveying route as a result of sliding rotary motions that may take place in difference areas, the adsorbed toner particles can be scraped off and developer can be stably conveyed under pressure.

FIG. 16 shows an arrangement where a pipe member 240 such as a developer conveying tube is connected to the suction port 231 of the developer reservoir base member 210 by means of the nipple 241 to form a developer conveying route there and convey developer to a desired position. As described above, a small clearance is provided between the outer periphery of the developer conveying screw 220 and that of the spring member 250 and the inner surface of the pipe member 240 to enhance the developer conveying effect and reliably scrape off the toner particles adsorbed to the inner surface of the pipe member 240 so that developer may be conveyed on a stable basis.

While the developer conveying screw 220 may be elongated without using the spring member 250 to convey developer to a desired position, the developer conveying route may have to be formed straight with such an arrangement. On the other hand, developer can be conveyed to a desired position if the developer conveying route shows curvatures provided that a spring member 250 is introduced into the developer conveying route so that restricting conditions can be lessened by introducing such a spring member 250.

While this embodiment is adapted to convey the developer scraped off from the image carrier 10Y, the present invention is by no means limited to such an arrangement and a developer conveying apparatus according to the present invention can be arranged at any of various positions in FIG. 1.

Now, an arrangement where a developer conveying apparatus is applied to the developer reservoir 18Y of the image carrier 10Y and an arrangement where a developer conveying apparatus is applied to the developer reservoir 24Y of the developing roller 20Y will be described below.

The viscosity of the developer scraped off from the image carrier cleaning blade 24Y of the image carrier 10Y is higher than the viscosity of the developer scraped off by the developing roller cleaning blade 21Y of the developing roller 20Y.

For the developer conveying apparatus 200, conveying developer showing a lower viscosity requires a greater conveying capacity. Therefore, the blade winding pitch of the developer conveying screw 220 of the developer conveying apparatus 200 of the developer reservoir 24Y is preferably smaller than the blade winding pitch of the developer conveying screw 220 of the developer conveying apparatus 200 of the developer reservoir 18Y.

Additionally, the number of revolutions per unit time of the developer conveying screw 220 of the developer conveying apparatus 200 of the developer reservoir 24Y is preferably greater than the number of revolutions per unit time of the developer conveying screw 220 of the developer conveying apparatus 200 of the developer reservoir 18Y.

The blade winding pitch of the developer conveying screw 220 of the developer conveying apparatus 200 of the developer reservoir 24Y can be made greater than that of the developer conveying screw 220 of the developer conveying apparatus 200 of the developer reservoir 24Y and at the same time the number of revolutions per unit time of the developer conveying screw 220 of the developer conveying apparatus 200 of the developer reservoir 24Y can be made greater than the number of revolutions per unit time of the developer conveying screw 220 of the developer conveying apparatus 200 of the developer reservoir 18Y.

Figure 17A:
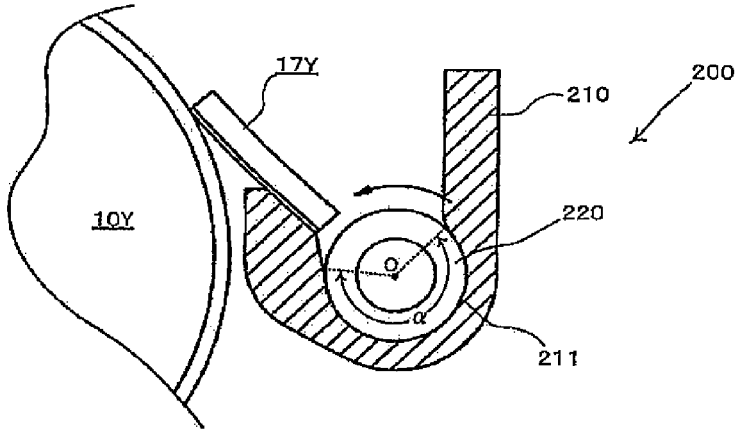
FIGS. 17A through 17C are schematic cross-sectional views of an embodiment of developer conveying apparatus taken at three positions in the longitudinal direction of the embodiment.
Figure 17B:
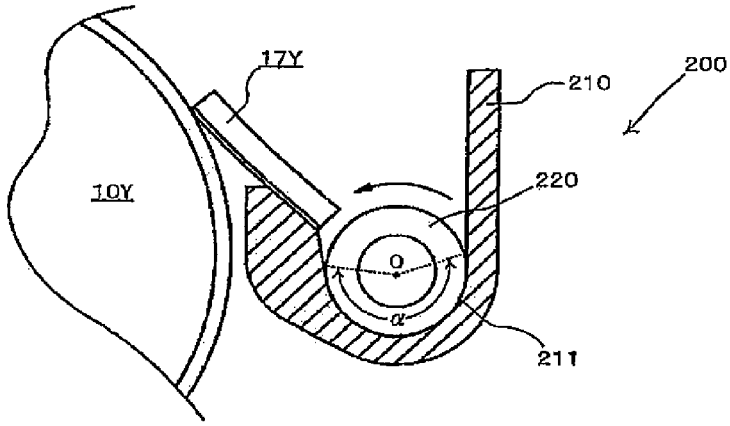
Figure 17C:
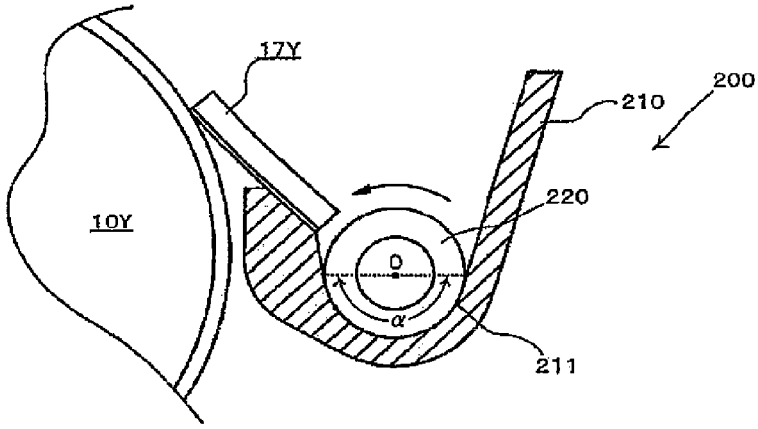

Now, an arrangement for enhancing the developer conveying capacity of a developer conveying apparatus according to the present invention will be described below. FIGS. 17A through 17C are schematic cross-sectional views of an embodiment of developer conveying apparatus 200 taken at three positions in the longitudinal direction of the embodiment.

FIG. 17A is schematic cross-sectional view taken at a position closest to the developer conveying base member 230 as viewed in the longitudinal direction of the developer reservoir base member 210 and FIG. 17C is a schematic cross-sectional view taken at a position remotest from the developer conveying base member 230, while 17B is a schematic cross-sectional view taken at an intermediate position between the preceding two positions. The difference among the cross-sectional views of FIGS. 17A through 17C is the extent to which the developer reservoir base member recess 211 covers the developer conveying screw 220.

The extent to which the developer reservoir base member recess 211 covers the developer conveying screw 220 can be defined by means of the central angle $\alpha$ corresponding to the extent to which the developer conveying screw 220 is covered. More specifically, the extent to which the cross section of the developer conveying screw 220 is covered by the developer reservoir base member recess 211 is defined by means of the central angle $\alpha$ in the circle having a center o of the cross section of the developer conveying screw 220.

Developer prepared by dispersing toner particles in carrier liquid shows surface tension and has a property of being adsorbed to the outer surface of the developer conveying screw 220 and part of the developer reservoir base member 210. Therefore, the developer adsorbed to the outer surface of the developer conveying screw 220 moves with the developer conveying screw 220, while the developer adsorbed to the developer reservoir base member 210 tends to remain at the adsorbed position.

Since the developer conveying function of the developer conveying screw 220 formed by arranging a spiral blade showing a predetermined winding pitch on the outer peripheral surface of a cylindrical base member is realized at the area where the developer conveying screw 220 cooperates with the arched surface of the developer reservoir base member 210 surrounding the outer periphery of the developer conveying screw 220, it is important to increase the area of the arched surface with which the developer conveying screw 220 cooperates.

The inventors of the present invention conducted various experiments on the basis of this theorem and came to a conclusion that a desired developer conveying capacity can be achieved when the central angle $\alpha$ shown in FIGS. 17A through 17C is not less than 180°.

It may be needless to say that the area of the arched surface with which the developer conveying screw 220 cooperates is increased to improve the developer conveying capacity when the central angle $\alpha$ is made large.

FIGS. 17A through 17C illustrate an embodiment based on the above finding. The central angle $\alpha$ is so defined as to increase from FIG. 17C toward FIG. 17A because the position where a high developer conveying capacity is required is located close to the developer conveying base member 230 where the scraped off developer accumulate as viewed in the longitudinal direction of the developer reservoir base member 210.

Now, an arrangement where a developer conveying apparatus is applied to the developer reservoir 18Y of the image carrier 10Y and an arrangement where a developer conveying apparatus is applied to the developer reservoir 24Y of the developing roller 20Y will be described below.

As pointed out above, the viscosity of the liquid developer scraped off from the image carrier 10Y is higher than the viscosity of the liquid developer scraped off from the developing roller 20Y.

For the developer conveying apparatus 200, conveying liquid developer showing a lower viscosity requires a greater conveying capacity. Therefore, the central angle $\alpha$ at the developer reservoir 24Y for conveying developer showing a lower viscosity is preferably defined to be larger than the central angle $\alpha$ at the developer reservoir 18Y.

In other words, when the central angle of the developer reservoir base member recess 211 of the developer conveying apparatus 200 for conveying the liquid developer scraped off from the image carrier 10Y is compared with the central angle of the developer reservoir base member recess 211 of the developer conveying apparatus 200 for conveying the liquid developer scraped off from the developing roller 20Y in a plane perpendicular to the developer conveying direction, the latter central angle is preferably defined to be larger than the former central angle.

With the arrangement according to the present invention as described above in detail, residual liquid developer that is electrically charged and in which toner particles can agglomerate and the toner density can be nonuniform can be conveyed smoothly. Then, as a result, the process of recycling residual liquid developer and that of disposing residual liquid developer as waste cannot be conducted smoothly.

Additionally, with the arrangement according to the present invention as described above, since toner particles in electrically charged residual liquid developer are prevented from being electrostatically adsorbed to the surfaces of some of the component members of the developer conveying sections, a situation where the residual liquid developer being conveyed is completely blocked can be effectively avoided.

Finally, an image forming apparatus employing developer conveying apparatus according to the present invention and having the above-described configuration can improve the efficiency of conveying residual liquid developer and is freed from a structure of circulating developer in a closed loop. Thus, an image forming apparatus employing developer conveying apparatus according to the present invention and having the above-described configuration can temporarily move residual liquid developer from the developing sites to some other position in order to mix it with fresh developer, dissolve agglomerations of toner particles and non-uniformity of toner density so as to disperse toner particles in a desired manner and/or dispose residual liquid developer as waste.

Figure 18:
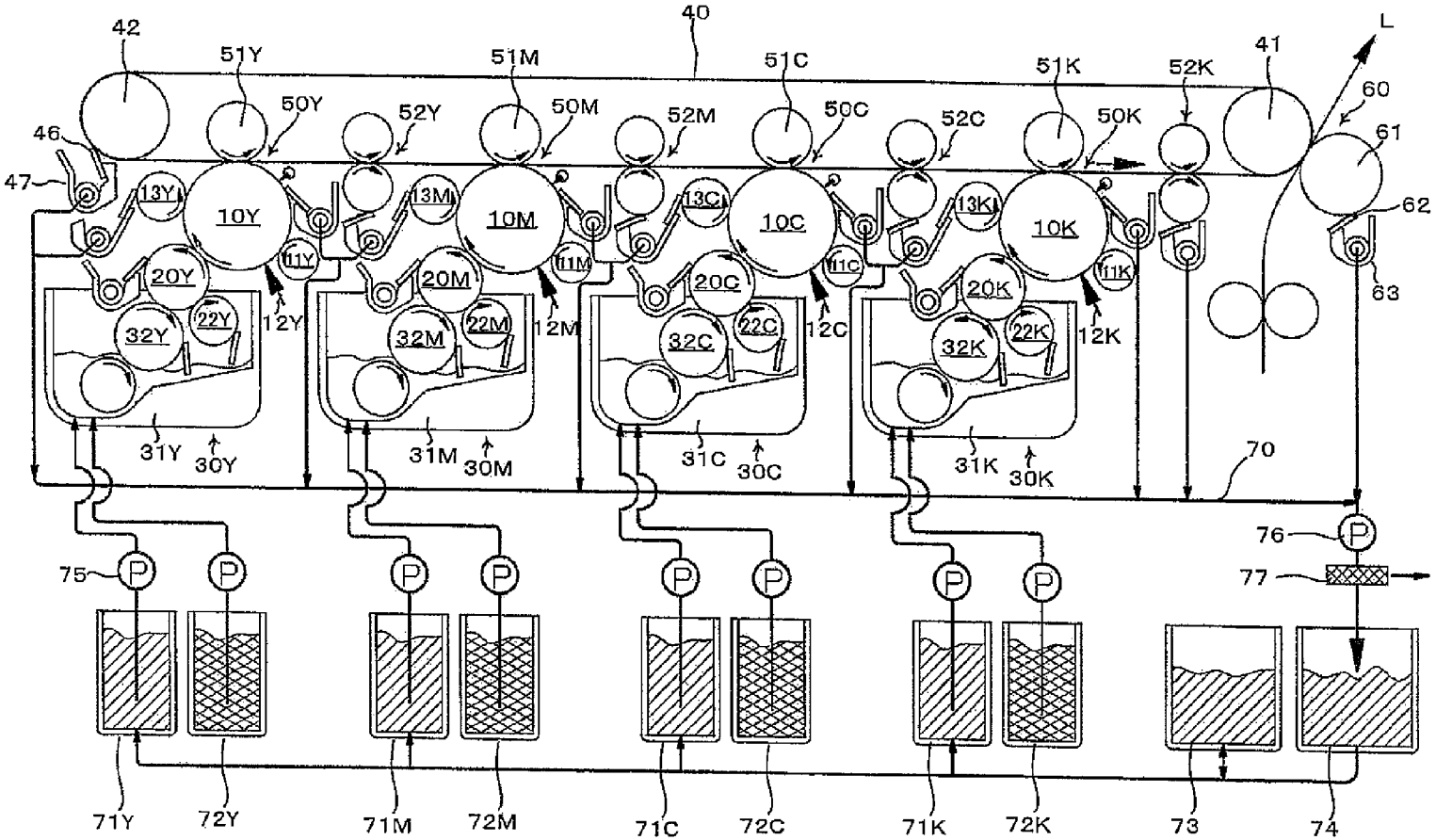
FIG. 18 is a schematic illustration of an image forming apparatus comprising another embodiment of developer conveying apparatus according to the present invention, showing principal components thereof.
Figure 19:
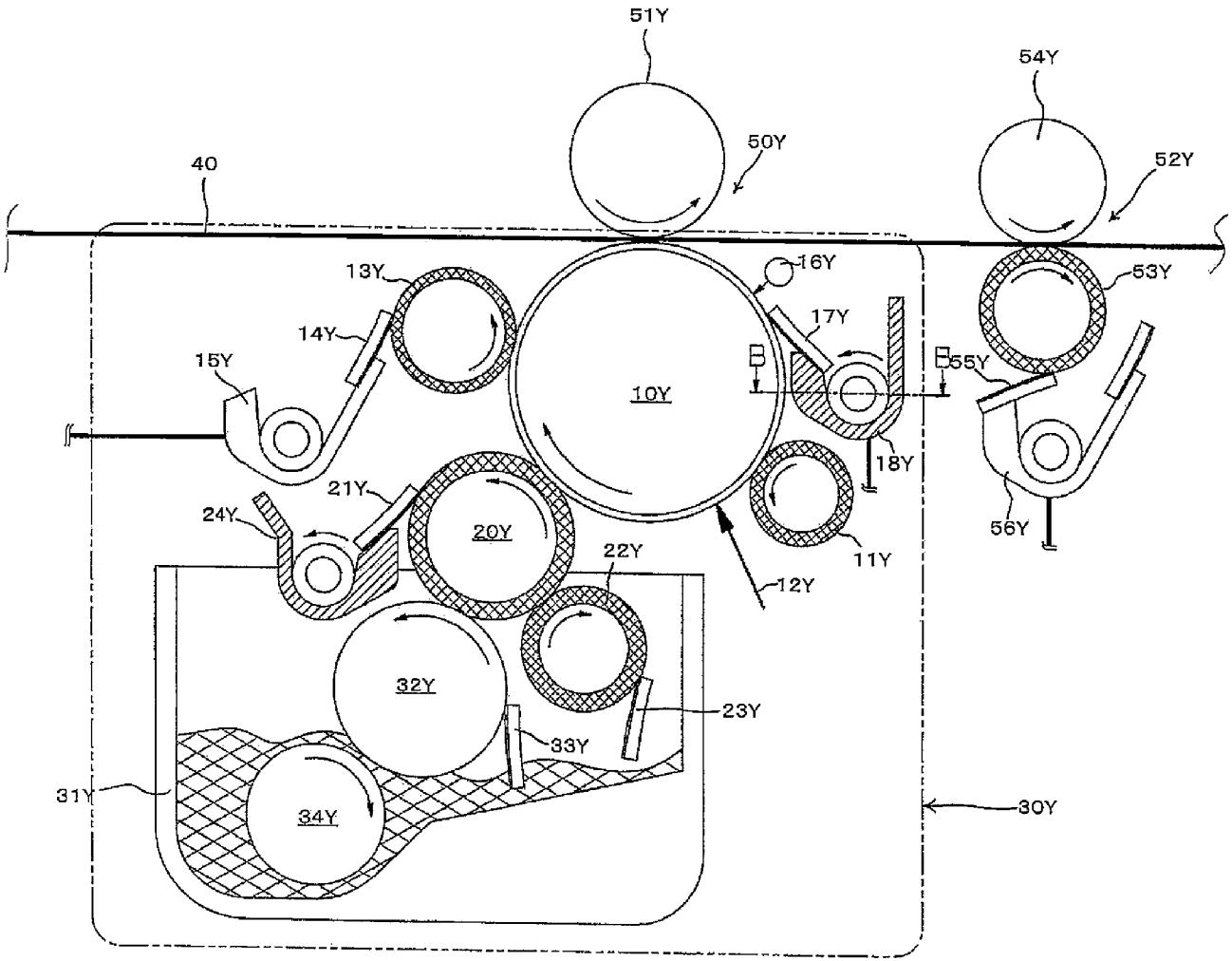
FIG. 19 is a schematic cross-sectional view of one of the image forming sections and the corresponding one of the development units of the embodiment of FIG. 18, showing principal components thereof.

Now, another embodiment of the present invention will be described below. FIG. 18 is a schematic illustration of an image forming apparatus comprising the embodiment of developer conveying apparatus according to the present invention, showing principal components thereof. FIG. 19 is a schematic cross-sectional view of one of the image forming sections and the corresponding one of the development units of the embodiment of FIG. 18, showing principal components thereof.

In FIG. 18, the components of the image forming section, the developing units and the intermediate transfer body squeezing apparatus that are same for yellow (Y), magenta (M), cyan (C) and black (K) are denoted respectively by the same reference symbols and suffixed by Y, M, C and K for discrimination. FIG. 19 illustrates the configuration of the image forming section, the developing unit and the intermediate transfer body squeezing apparatus for yellow (Y). Now, the image forming section, the developing unit and the intermediate transfer body squeezing apparatus for yellow will be described in detail below. The following description applies to all the four colors.

In the image forming section, a cleaning apparatus including a latent image eraser 16Y, a image carrier cleaning blade 17Y and a developer reservoir 18Y, a charging roller 11Y, a exposure unit 12Y, a developing roller 20Y of the developing unit 30Y and another cleaning apparatus including an image carrier squeezing roller 13Y, a cleaning blade 14Y which is an annex to the squeezing roller 13Y and a developer reservoir 15Y are arranged along the outer periphery of the image carrier 10Y in the above mentioned order in the rotational direction (moving direction) thereof.

In the developing unit 30Y, a cleaning blade 21Y, a developer feed roller 32Y which is an anilox roller, a control blade 33Y for controlling the quantity of supplied developer, a developer compression roller 22Y and a cleaning blade 23Y for scraping off the developer on the surface of the developer compression roller 22Y are arranged around the developing roller 20Y and a developer agitating roller 34Y is arranged in the developer container (reservoir) 31Y to agitate the developer contained in the developer container (reservoir) 31Y in order to produce a uniformly dispersed state for the toner in the developer. A primary transfer roller 51Y of primary transfer section SOY is arranged at a position opposite to the image carrier 10Y with the intermediate transfer body 40 interposed between them and an intermediate transfer body squeezing apparatus 52Y and primary transfer sections 50 (M, C, K) of the other colors are sequentially arranged along the intermediate transfer body 40 at respective downstream positions as viewed in the moving direction of the intermediate transfer body 40. The intermediate transfer body squeezing apparatus 52Y includes an intermediate transfer body squeezing roller 53Y, a backup roller 54Y, an intermediate transfer body squeezing roller cleaning blade 55Y and a developer reservoir 56Y.

The developer that is contained in the developer container 31Y is not a popular volatile developer prepared by using Isopar (trademark: available from Exxon) as carrier and showing a low toner concentration (about 1 to 2 wt %), a low viscosity and volatility at room temperature but a non-volatile liquid developer showing a high toner concentration and a high viscosity that is not volatile at room temperature. More specifically, developer to be used for this embodiment is a high viscosity (about 30 to 10,000 mPa·s) developer prepared by adding a solid particles having an average particle size of 1 μm obtained by dispersing a coloring agent such as a pigment into thermoplastic resin into a liquid solvent, which may be an organic solvent, silicon oil, mineral oil or edible oil, to make the toner solid concentration equal to about 25%. The toner concentration of the liquid developer in the developer container 31Y changes as it is consumed to form a developed image on the image carrier. Therefore, developer in which toner is dispersed to show a high concentration of 35 to 55 wt % is supplied from developer cartridge 72Y while supplying carrier from carrier cartridge 71Y and the developer and the carrier are agitated by means of the developer agitating roller 34Y to produce a uniformly dispersed state. Thus, the weight ratio is 75% for the carrier and 25% for the toner.

In the image forming section and the developing unit 30Y, the image carrier 10Y is uniformly electrically charged by means of the charging roller 11Y and a laser beam is irradiated onto the image carrier 10Y by means of the exposure unit 12Y that has an optical system including a semiconductor laser, a polygon mirror and an F-θ lens and modulated according to the input video signal to form an electrostatic latent image on the electrically charged image carrier 10Y. Liquid developer of each of the four colors (yellow here) is supplied from the developer container 31Y storing liquid developer, controlling the supplied quantity of developer by means of the control blade 33Y, and then from the developer feed roller 32Y to the developing roller 20Y in order to develop the electrostatic latent image formed on the image carrier 10Y. The intermediate transfer body 40 is a resilient endless belt member extending between a drive roller 41 and tension roller 42 so as to be driven to rotate by the drive roller 41, contacting the image carriers 10Y, 10M, 10C, 10K at primary transfer sections 50Y, 50M, 50C, 50K respectively. Primary transfer rollers 51Y, 51M, 51C, 51K are arranged respectively opposite to the image carriers 10Y, 10M 10C, 10K with the intermediate transfer body 40 interposed between them at the primary transfer sections 50Y, 50M, 50C, 50K so that the developed toner images of the different colors on the image carriers 10Y, 10M, 10C, 10K are sequentially transferred onto the intermediate transfer body 40 and laid one on the other at the transfer positions, or the contact positions of the primary transfer rollers 51Y, 51M, 51C, 51K and the image carriers 10Y, 10M, 10C, 10K, to produce a full color toner image. Thus, the toner images formed on the plurality of image carriers (photosensitive bodies) 10Y, 10M, 10C, 10K are sequentially laid one on the other on and borne by the intermediate transfer body 40 before they are collectively transferred onto a sheet member for secondary transfer. Note that the intermediate transfer body 40 is a resilient belt selected to improve the secondary transfer performance, following the surface profile of the sheet onto which a toner image is to be transferred for the secondary transfer if the surface of the sheet is fibrous and not very smooth and the multi-color toner image is produced by sequentially laying a plurality of monochromatic toner images formed on the photosensitive bodies one on the other.

Secondary transfer unit 60 includes a secondary transfer roller 61 that is arranged opposite to the belt drive roller 41 with the intermediate transfer body 40 and a cleaning apparatus that by turn includes a secondary transfer roller cleaning blade 62 and a developer reservoir 63. Then, a monochromatic toner image or a full color toner image formed on the intermediate transfer body 40 is transferred for secondary transfer onto a recording medium, which may be a sheet of paper, a sheet of film or a sheet of cloth, being conveyed along sheet conveying route L, at the transfer position where the secondary transfer unit 60 is arranged. A fixing unit (not shown) is arranged at a downstream position of the sheet conveying route L to fuse the monochromatic toner image or the full color toner image that is transferred onto the recording medium, or the sheet, and fix it to the latter to finally end the image forming operation on the sheet. Note that the secondary transfer roller 61 is also a resilient belt selected to improve the secondary transfer performance so as to operate as a resilient roller having a resilient body formed on the surface, following the surface profile of the sheet onto which a toner image is to be transferred if the surface of the sheet is fibrous and not very smooth and the multi-color toner image is produced by sequentially laying a plurality of monochromatic toner images formed on the photosensitive bodies one on the other. The purpose of employing a resilient belt is same as that of employing a resilient belt for the intermediate transfer body 40 on which the toner images formed on the plurality of image carriers (photosensitive bodies) 10Y are sequentially laid one on the other so as to be borne by it before they are collectively transferred onto a sheet member for secondary transfer.

At the side of the tension roller 42 to which the intermediate transfer body 40 extends from the belt drive roller 41, an cleaning apparatus including a cleaning blade 46 and a developer reservoir 47 is arranged near the outer periphery of the tension roller 42 at a position downstream as viewed in the moving direction of the intermediate transfer body 40. After passing by the secondary transfer unit 60, the intermediate transfer body 40 moves to the winding contact of the tension roller 42, where the surface of the intermediate transfer body 40 is cleaned by the cleaning blade 46, and then it proceeds toward the primary transfer section 50 once again.

The toner particles in the developer contained in the developer container 31Y have a positive electric charge. The developer is agitated by the agitating roller 34Y to uniformly disperse the toner particles and then pumped up from the developer container 31Y as the developer feed roller 34Y rotates. The pumped up developer is controlled for the quantity thereof by the control blade 33Y and then supplied to the developing roller 20Y. The developer that is stored initially in the developer container 31Y is in a state where toner is dispersed to show a weight ratio of about 25% into a carrier. However, the toner consumption ratio is high when the image forming duty is high in the process of developing the latent image on the image carrier 10Y, whereas the toner consumption ratio is low when the image forming duty is low in the process. In other words, the weight content ratio of toner of the developer stored in the developer container 31Y changes incessantly as the latent image on the image carrier 10Y is developed so that it is necessary to constantly monitor the change and maintain and control the developer in a state where the toner is well dispersed to show a weight ratio of about 25%.

Although not shown in FIG. 19, a transmission type photosensor for detecting the weight ratio of the dispersed toner or a torque detection means for detecting the agitating torque of the developer agitating roller 34Y and a reflection type photosensor for detecting the liquid surface of the developer in the developer container 31 are arranged in the developing unit 30Y along with other members. Their counterparts are also arranged in each of the remaining developing units. When the weight ratio of the dispersed toner falls low in a predetermined quantity of developer in the developer container 31, developer containing toner to a high concentration of 35 to 55% by weight is supplied from the developer cartridge 72Y to the developer container 31Y by a predetermined quantity. When, on the other hand, the weight ratio of the dispersed toner rises high in the developer container 31Y, carrier is supplied from the carrier cartridge 71Y to the developer container 31Y by a predetermined quantity. Thus, the weight ratio of the toner in the developer container 31Y is controlled to about 25% by means of such a supply system. The toner concentration of developer can be predicted by a controller (CPU) that controls video signals, seeing the density of the image it outputs, to control the quantity of developer to be supplied from the developer cartridge 72Y or that of carrier to be supplied from the carrier cartridge 71Y. The responsiveness and the reliability of controlling the toner density can be improved by such a prediction and control scheme.

Thus, with the developer collecting system of this embodiment, developer containing dispersed toner to a high concentration is supplied from the developer cartridge 72Y or carrier is supplied from the carrier cartridge 71Y according to the toner concentration of the developer in the developer container 31Y that changes according to the developing process conducted on the image carrier so as to keep the concentration of uniformly dispersed toner to a constant level of 25% by weight relative to 75% by weight of carrier. In the final stage of the image forming operation where the visual image formed on a sheet by secondary transfer proceeds to a fixing process (not shown) after a variety of processes, toner is preferably well dispersed and contained by 40% to 60% by weight in the developer in order to make the secondary transfer function and the fixing function to be exerted satisfactorily. For this purpose, so-called developer collecting means for collecting residual liquid developer and residual carrier including image carrier squeezing apparatus (13 through 15), image carrier cleaning apparatus (17, 18), intermediate transfer body squeezing apparatus (52 through 55), an intermediate transfer body cleaning apparatus (46, 37) and a secondary transfer roller cleaning apparatus (62, 63) and other apparatus are arranged at a plurality of positions, which include the above-described cleaning blade.

In this embodiment, the developer scraped off by the cleaning blade 14Y and collected by the developer reservoir 15Y of the first color, the developer scraped off by the cleaning blade 44 and collected by the developer reservoir 45 and the developer scraped off by the cleaning blade 46 and collected by the developer reservoir 47 are put together by way of a single flow path. Then, the developer scraped off by the cleaning blade 17Y and collected by the developer reservoir 18Y and the developer scraped off by the cleaning blade 55Y and the cleaning blade 14M of the next color and collected by the developer reservoir 56Y are put together by way of a single flow path. Similarly, the developers collected in the same way are put together by way of a single flow path for each of the second and colors. Then, the developer scraped off by the cleaning blade 17K and collected by the developer reservoir 18K and the developer scraped off by the cleaning blade 55K and collected by the developer reservoir 56K for the fourth color are put together by way of a single flow path Finally, these flow paths and the flow path of the developer scraped off by the cleaning blade 62 and collected by the developer reservoir 63 are put together to produce a developer collecting flow path 70 and the collected developer is conveyed from a pump 76 to a filter means 77.

The developer scraped off by the cleaning blades and collected is then stored for reuse in the carrier buffer tank 74 from the collecting flow path 70 produced by putting together the developer conveying flow paths by way of the filter 77. As developers used for development by a plurality of developing units are collected together, toners of different colors are mixed with each other so that they may not simply be reused. Therefore, a filter means 77 is arranged on the conveying route to filter the toner particles and reuse only the carrier. The carrier stored in the carrier buffer tank 74 is reused as it is conveyed and delivered to the carrier cartridge 71Y by way of developer conveying path 78 so that developer is supplied from the developer cartridge 72Y to the developer container (reservoir) 31Y while carrier is supplied from the carrier cartridge 71Y.

The filter means 77 filters the developer collected by way of the above listed developer collecting means and the collecting flow path produced by merging the flow paths and isolates the toner sold and the paper powder contained in the developer from the carrier component. Typically, a paper filter, an electrostatic filter or some other appropriate filter is employed for it. The carrier, from which toner and other contents are separated to become ready for reuse, is then stored in the carrier buffer tank 74. Thus, a reuse system is established for conveying and distributing carrier from the carrier buffer tank 74 storing filtered carrier to the carrier cartridges 71 of the plurality of developing units. The reuse system can provide an averaged reuse ratio for reusing carrier on a stable basis. The above-described arrangement can be made very simple and realized at low cost when a single pump 76 and a single filter means 77 are used along with the conveying route to convey developer. The developer collected from the cleaning apparatus of the secondary transfer roller 61 and that of the intermediate transfer body 40 may contain foreign objects and paper powder so that it may be simply disposed as waste without being reused. However, the developer collected from the different sections can be reused by setting up a filtering process as in the case of this embodiment. The filtering function of the reuse system can be stably maintained by establishing a system for removing the toner of mixed colors, the foreign objects and the paper powder removed by the filtering means 77 according to the outcome of detection of a detection means (not shown) for detecting the condition of the filter.

A relative shortage of carrier can occur when the weight ratio of toner in the developer supplied from the developer cartridge 72Y is high, whereas a relative excess of carrier can take place when the weight ratio of toner in the developer supplied from the developer cartridge 72Y is low. The carrier cartridge 71Y is removably fitted to the carrier conveying route along with the developer cartridge 72Y in this embodiment so that carrier may be supplied in a simple manner. When not only the weight ratio of toner is low but also the image duty is high in a developing process, the weight ratio of toner is raised to 40% to 60% for the fixing process, supplying developer showing a toner weight ratio of 35% to 55% from the developer cartridge 72Y so that carrier will be collected by a large amount to produce a situation where carrier is in excess. Since the developer cartridge 72Y contains developer that by turn contains toner in a dispersed state to a high concentration of 35% to 55% by weight, the collected carrier is relatively in excess when developer is consumed for a developing process where the image duty is high. When carrier is stored in excess, another carrier containing tank 73 that can be removably fitted to the carrier conveying route is provided in this embodiment. The carrier containing tank 73 is a tank different from the carrier buffer tank 74 and, when it is filled with carrier, it is removed with the carrier in the inside. With this arrangement, the carrier containing tank that is full can be replaced by an empty carrier containing tank and held in storage so that carrier can be efficiently reused and the carrier buffer tank 74 is not required to have an extremely large capacity. Thus, the entire image forming apparatus can be downsized.

The carrier cartridge tank 71Y may be omitted. Then, carrier is directly and appropriately supplied from the carrier buffer tank 74 to the developer container 31Y. When the carrier cartridge 71Y is removably fitted to the carrier conveying route with the developer cartridge 72Y so as to be compatible with the carrier containing tank 73, the carrier cartridge 71Y can be used as carrier containing tank 73 when it becomes empty to a remarkably convenience. While carrier may be made to flow in opposite directions along the carrier conveying route relative to the carrier cartridge 71Y and the carrier containing tank 73, a check valve may be provided to prevent carrier from unexpectedly flowing out. The provision of a check value is also advantageous for fitting and removing the carrier cartridge 71 and the carrier containing tank 73.

While developer may be compounded in advance by means of a compounding bottle arranged in addition to the developing unit before supplying developer to the developer container 31Y, considerable attention needs to be paid in order to prevent any control time lag from appearing relative to the toner concentration of the developer in the developer container 31Y that incessantly changes. However, no concentration control time lag arises and the toner concentration can be controlled stably with this embodiment, where developer containing toner to a predetermined weight ratio in a dispersed state and carrier are supplied to the developer container 31Y and agitated to uniformly disperse the toner particles according to the outcome of detection of the detection means for detecting the weight ratio of toner and that of the detection means for detecting the current quantity of developer in the developing unit.

As described above, this embodiment is adapted to scrape off and collect developer by means of cleaning apparatus having respective developer collecting means and the collected developer is distributed to the developing units 30Y for reuse. Now, the developer collecting means of this embodiment will be described in greater detail below. The developing unit 30Y has a cleaning blade 23Y for cleaning the toner compression roller 22Y for compressing the toner in the developer borne on the developing roller 20Y and a cleaning blade 21Y for cleaning the developing roller 20Y. The cleaning blade 21Y is arranged downstream relative to the developing nip section where the developing roller 20Y is held in contact with the image carrier 10Y in the rotational direction of the developing roller 20Y in order to scrape off the developer remaining on the developing roller 20Y. On the other hand, the cleaning blade 23Y scrapes off and removes the developer on the toner compression roller 22Y that rotates in the direction indicated by an arrow in FIG. 19 and puts (adds) it to the developer in the reservoir 31Y for reuse. Note that the added carrier and toner do not show any color mixing.

The image carrier squeezing apparatus is arranged opposite to the image carrier 11Y at a position downstream relative to the developing roller 20Y in the rotational direction of the image carrier 10Y. It includes an image carrier squeezing roller 13Y, a cleaning blade 14Y pressed against and held in contact with the surface of the image carrier squeezing roller 13Y to clean the surface and a developer reservoir 15Y and is adapted to collect the residual liquid developer on the image carrier 10Y and the fogging toner that is intrinsically unnecessary to raise the content ratio of the toner particles in the visible image. In this embodiment, the image carrier squeezing roller 13Y is driven to rotate with the image carrier 10Y at a peripheral speed substantially same as that of the image carrier 10Y to collect the residual carrier from the developer consumed by the image carrier 10Y to develop the latent image by 5 to 10% from the viewpoint of reducing the load of driving the two rollers and the effect of suppressing the turbulence of the visualized toner image that can be externally caused by the image carrier 10Y. The residual carrier and the unnecessary fogging toner collected by the image carrier squeezing roller 13Y are collected from the image carrier squeezing roller 13Y by the cleaning effect of the cleaning blade 14Y and pooled in the developer reservoir 15Y. Note that the residual carrier and the fogging toner that are collected do not show any color mixing in the image forming section because they are collected from the image carrier 10Y dedicated for yellow images.

The drive load of revolutions and moves is reduced and, at the same time, the effect of external turbulences on the visible toner image on the image carrier 40 is suppressed in the primary transfer section 50 by equalizing the peripheral speed of the image carrier 10Y and the moving speed of the intermediate transfer body 40 for transferring the developer image developed by the image carrier 10Y onto the intermediate transfer body 40 by means of the primary transfer roller 51Y. While no color mixing problem arises at the primary transfer section 50Y because yellow is the first color, a reverse transfer phenomenon where toner moves from the intermediate transfer body 40 to the image carriers 10M, C, K) can appear as the second, the third and the fourth toner images are sequentially laid on the first toner image that is already put on the intermediate transfer body 40 by a primary transfer. Then, the reversely transferred toner and the toner remaining on the image carriers after the transfer are mixed with each other to give rise to color mixing and borne by the image carriers 10(M, C, K) to move before they are collected from the image carriers and pooled by the cleaning blades 17(M, C, K).

In the final stage of the image forming operation where the visual image formed on a sheet by secondary transfer proceeds to a fixing process (not shown), developer (toner dispersed in carrier) is preferably well dispersed and contained by 40% to 60% by weight in the developer in order to make the secondary transfer function and the fixing function to be exerted satisfactorily. The intermediate transfer body squeezing apparatus 52Y is arranged as means for further removing residual carrier from the intermediate transfer body 40 when the developer in the final stage does not show a desired dispersed state. The intermediate transfer body squeezing apparatus 52Y is arranged downstream relative to the primary transfer section SOY as viewed in the moving direction of the intermediate transfer body 40 and includes an intermediate transfer body squeezing roller 53Y, a backup roller 54Y arranged opposite to the intermediate transfer body squeezing roller 53Y with the intermediate transfer body 40 interposed between them, a cleaning blade 55Y pressed against the intermediate transfer body squeezing roller 53Y to slide thereon and clean the surface of the intermediate transfer body 40 and a developer reservoir 15M. It has a function of collecting the residual carrier from the developer consumed by the intermediate transfer body 40 for the primary transfer. The developer reservoir 15M also operates as a mechanism for collecting the carrier liquid collected by the cleaning blade 14M of the image carrier squeezing roller for magenta that is arranged downstream as viewed in the moving direction of the intermediate transfer body 40 and also the carrier liquid collected by the cleaning blade 55Y of the intermediate transfer body squeezing roller 53Y. In this way, the developer reservoirs 15(M, C, K) of the image carrier squeezing apparatus of the second and subsequent colors are adapted to operate respectively as developer reservoirs of the intermediate transfer body squeezing apparatus 52(Y, M, C) arranged downstream relative to the primary transfer sections 50(Y, M, C) of the immediately preceding colors as viewed in the moving direction of the intermediate transfer body 40. Thus, developer reservoirs 15 can be arranged at regular intervals to simplify the secondary transfer roller 61 and downsize the entire apparatus.

No color mixing problem arises at the intermediate transfer body squeezing site for yellow that is the first color because it is the first intermediate transfer body squeezing site. However, color mixing takes place with the second color as toner is moved from the intermediate transfer body 40 to the intermediate transfer body squeezing roller 53Y because an additional toner image is transferred onto the site of the toner image where a toner image has already been transferred so that different colors are laid one on the other. Then, the toner of the mixed colors is borne on the intermediate transfer body squeezing roller 53Y with the residual carrier and moved until it is collected from the intermediate transfer body squeezing roller 53Y and pooled by the corresponding cleaning blade. However, note that an intermediate transfer body squeezing apparatus 52 may not necessarily be arranged downstream relative to each of the primary transfer processes when the squeezing capacity of the image carrier 11Y at the primary transfer site upstream relative to the site where the above-described intermediate transfer body squeezing process is conducted and the squeezing capacity of the image carrier squeezing roller 53Y are sufficiently large.

A sheet, or a recording medium, is supplied synchronously at the time when the multi-color toner image on the intermediate transfer body 40 arrives at the secondary transfer site and the toner image is transferred onto the sheet in a secondary transfer operation. Then, the sheet is fed to a fixing process (not shown) to end the operation of forming an image on the sheet. However, if a trouble such as a jam arises on the sheet being fed, not all the toner image is transferred onto the secondary transfer roller and collected but the toner image is partly left on the intermediate transfer body. Additionally, in ordinary secondary transfer processes, the toner image on the intermediate transfer body 40 is not transferred onto a sheet by 100% in the secondary transfer process but the toner is left on the intermediate transfer body 40 by several percents. Particularly, if a trouble such as a jam arises on the sheet being fed, the toner image is transferred from the intermediate transfer body 40 onto the secondary transfer roller 61 because no sheet is there. Then, the rear surface of the sheet that arrives thereafter is smeared by the toner on the secondary transfer roller 61. The unnecessary toner on the intermediate transfer body 40 is cleaned off by the cleaning blade 46 of the intermediate transfer body and the unnecessary toner on the secondary transfer roller 61 is cleaned off by the cleaning blade 62 of the secondary transfer roller. Thus, the secondary transfer roller cleaning blade 62 is provided as means for removing the developer (containing toner particles dispersed in carrier) transferred onto the secondary transfer roller 61 and collects the developer from the secondary transfer roller 61 so as to pool it. The pooled developer shows a mixture of colors and can contain foreign objects such as paper powder. They are isolated by the filter 77 as described above.

Figure 20:
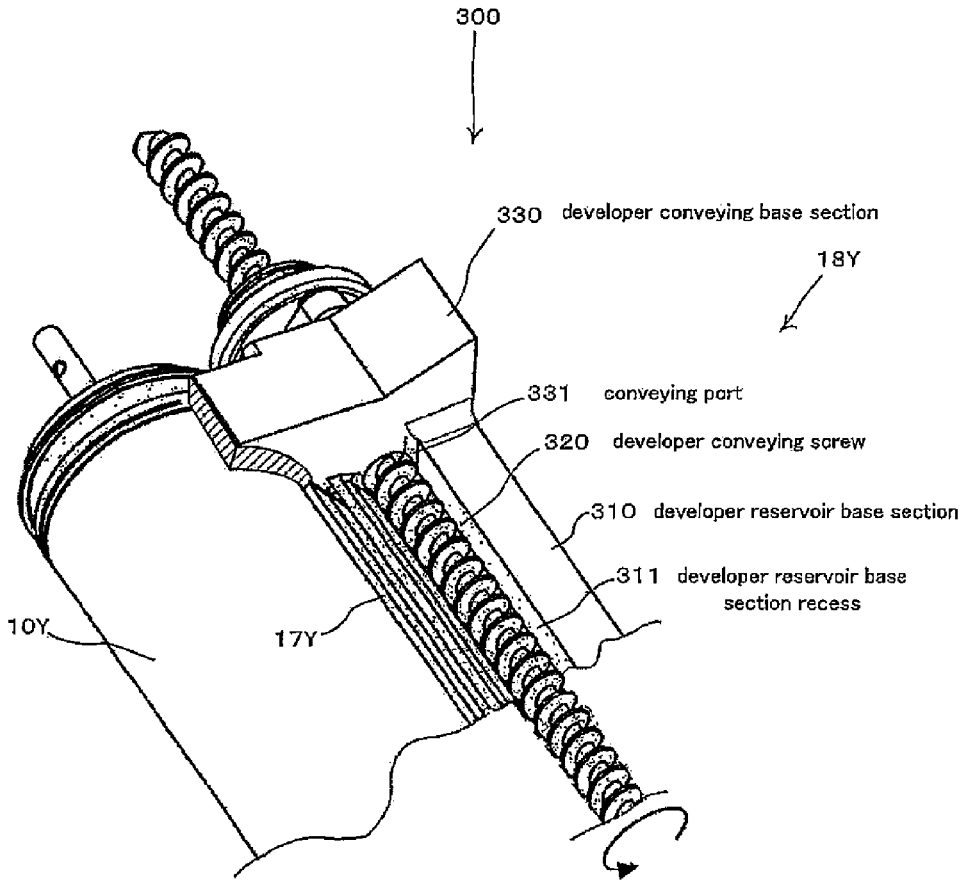
FIG. 20 is a schematic perspective view of the developer conveying apparatus of the developer reservoir 18Y.
Figure 21:
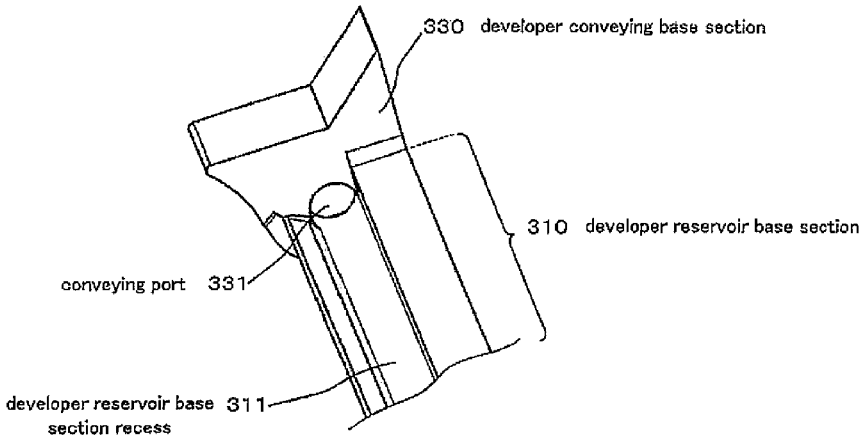
FIG. 21 is a schematic perspective view of the developer conveying base section 330 and the developer reservoir base section 310 of the embodiment of FIG. 18, showing the configuration thereof.
Figure 22:
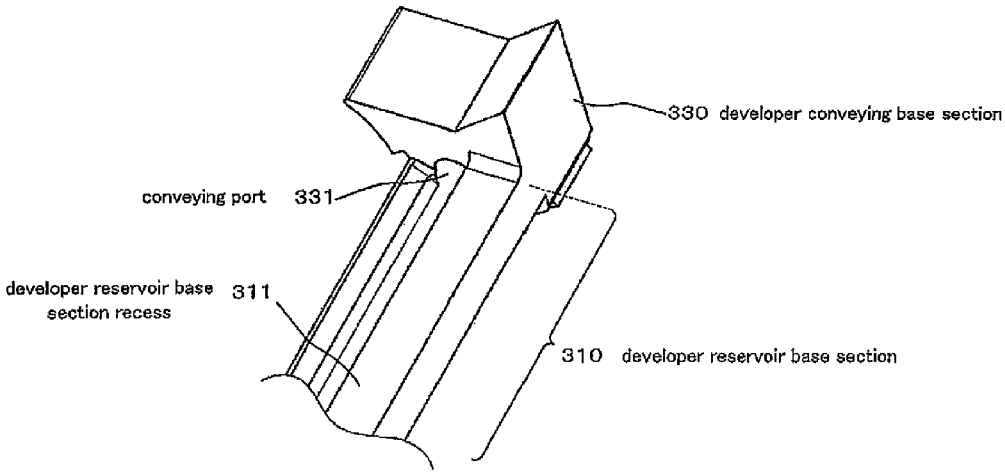
FIG. 22 is a schematic perspective view of the developer conveying base section 330 and the developer reservoir base section 310 of the embodiment of FIG. 18, showing the configuration thereof.
Figure 23:
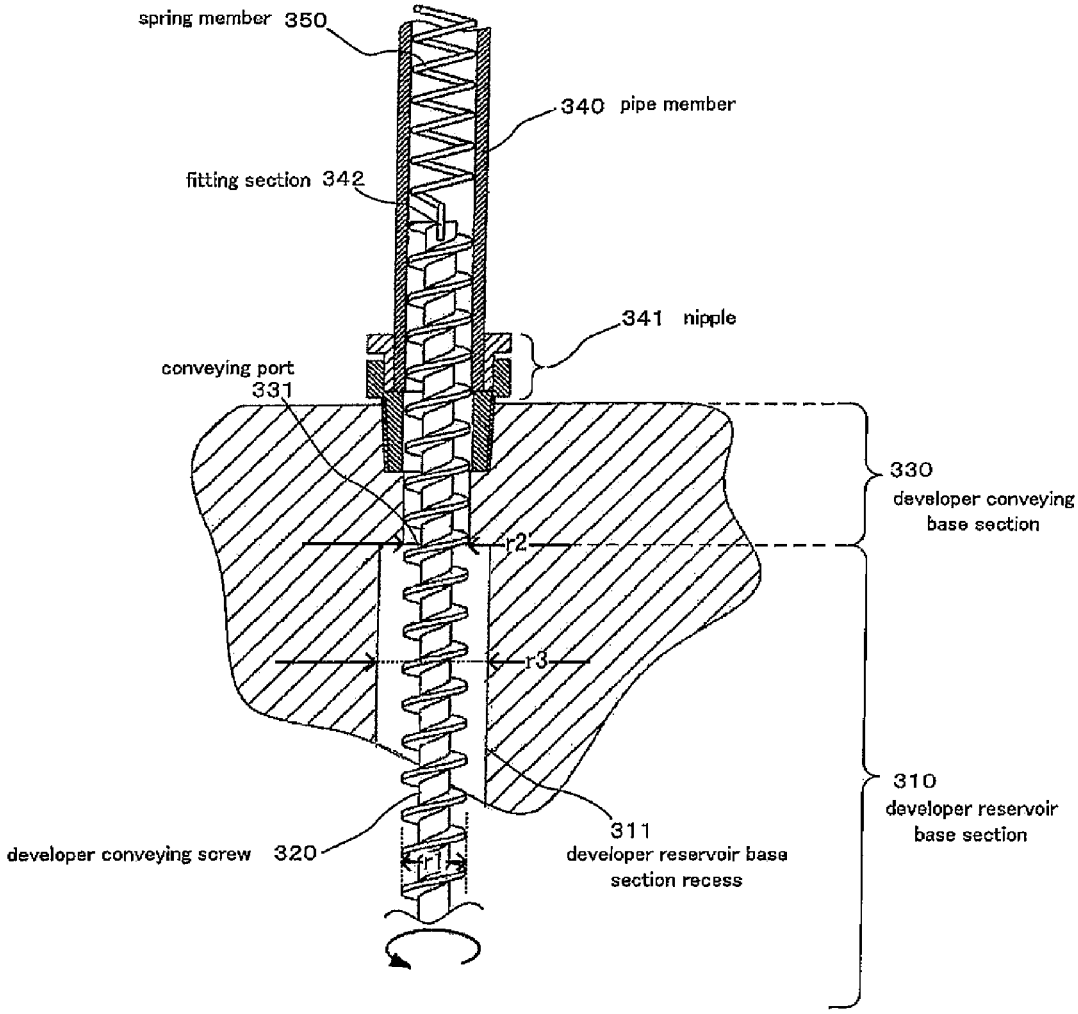
FIG. 23 is a schematic illustration of an image forming apparatus comprising still another embodiment of developer conveying apparatus according to the present invention, showing principal components thereof.

Now, the configuration of the developer reservoirs that utilize an embodiment of developer copying apparatus according to the present invention will be described below. FIG. 20 is a schematic perspective view of the developer conveying apparatus of the developer reservoir 18Y. FIG. 21 is a schematic perspective view of the developer conveying base section 330 and the developer reservoir base section 310 of the embodiment, showing the components thereof. FIG. 22 is a schematic perspective view of the developer conveying base section 330 and the developer reservoir base section 310 of the embodiment, showing the configuration thereof, as viewed from an angle different from the view angle of FIG. 21. FIG. 23 is a schematic illustration of an image forming apparatus comprising still another embodiment of developer conveying apparatus according to the present invention, showing principal components thereof. Note that FIG. 23 is a cross-sectional view taken along line B-B in FIG. 19. While the expression of "base member" is employed in the description given above by referring to FIGS. 15 and 16, expression of "base section" may be used in the following description of the embodiment, although they denote a substantially same item.

In FIGS. 21 through 23, 300 denotes a developer conveying apparatus and 310 and 311 respectively denote a developer reservoir base section and a developer reservoir base section recess, whereas 320, 330 and 331 respectively denote a developer conveying screw, a developer conveying base section and a suction port and 340, 341, 342 and 350 respectively denote a pipe member, a nipple, a fitting section and a spring member.

As shown in FIG. 19, after transferring the developer from the image carrier 10Y to the intermediate transfer body 40 for primary transfer, the remaining developer left on the image carrier 10Y is scraped off by the image carrier cleaning blade 17Y and stored in the developer reservoir 18Y. More specifically, it is temporarily stored in the developer reservoir base section 310 of the developer conveying apparatus 300 that is incorporated into the developer reservoir 11Y and then conveyed from the developer reservoir base section 310 to the developer conveying base section 330 arranged at a longitudinal end of the developer reservoir base section 310.

The developer conveying screw 320 is formed by arranging a spiral blade showing a predetermined winding pitch on the outer periphery of a cylindrical base section and disposed in the developer reservoir base section recess 311 of the developer reservoir base section 310 so that the cylindrical base section and the spiral blade are driven to rotate integrally in order to convey developer in an axial direction. The developer reservoir base section recess 311 has a profile adapted to cover the developer conveying screw 320 and the radius of curvature thereof is so defined as to be slightly larger than the radius of the conveying port 331. More specifically, if the half diameter of the outer peripheral section of the developer conveying screw 320 and the half diameter of the conveying port 331 is r2 while the radius of curvature of the recess of the developer reservoir base section recess 311 is r3, the developer conveying apparatus is so designed as to make the relationship of $r1<r2<r3$ hold true.

The developer reservoir 18Y includes a developer reservoir base section recess 311 that shows a subsequently U-shaded longitudinal cross section with an open upper end so as to be adapted to store the developer scraped off from the image carrier 10Y and discharges developer from an end of the developer reservoir base section 310 in an axial direction. The circular conveying port 331 is formed on the developer conveying base section 330 arranged at an end of the developer reservoir base section 310. The developer conveying screw 320 is introduced into the conveying port 331 and driven to rotate. The diameter of the conveying port 331 is such that it allows the developer conveying screw 320 to move through it with a small margin. The developer conveying screw 320 extends from the inside of the developer reservoir base section recess 311 to the inside of the conveying port 331 of the developer conveying base section 330 to realize a remarkable pumping effect of pumping developer to the conveying port 331.

The developer conveying screw 320 is driven to rotate and conveys developer under the condition where the top end of the developer reservoir base section 310 is opened. The pumping effect of the developer developing screw 320 is terminated when the developer being conveyed appears at the top end of the developer conveying screw 320 introduced into the conveying port 331. Then, the developer is conveyed further to a desired position from there under pressure.

The developer conveying base section 330 is provided with a hole that is held in communication with the conveying port 331 and the pipe member 340 is fitted to the hole by means of the nipple 341. The developer conveying screw 320 extends into the pipe member 340 and the spring member 350 is arranged in the pipe member 340 and fitted to the developer conveying screw 320 by means of the fitting section such that the outer periphery of the spring member 350 slides on the inner wall of the pipe member 340.

On the other hand, the developer stored in the developer reservoir 11Y shown in FIG. 19 is the developer scraped off from the image carrier and hence it is electrically charged. In other words, toner particles in the developer are apt to agglomerate and become electrostatically adsorbed to other members. Thus, toner particles can highly probably be adsorbed to the inner surface of the developer conveying route when developer is fed under pressure by the above-described pumping effect.

Therefore, a spring member 350 formed with a predetermined winding pitch is mounted to and supported by the projecting end of the developer conveying screw 320 so as to be able to rotate integrally with the developer conveying screw 320 in this embodiment. A small clearance is provided between the outer periphery of the spring member 350 and the inner surface of the developer discharge port so that, if toner particles are electrostatically adsorbed to the inner surface of the developer conveying route as a result of sliding rotary motions that may take place in difference areas, the adsorbed toner particles can be scraped off and developer can be stably conveyed under pressure.

FIG. 16 shows an arrangement where a pipe member 340 such as a developer conveying tube is connected to the conveying port 331 of the developer reservoir base section 310 by means of the nipple 341 to form a developer conveying route there and convey developer to a desired position. As described above, a small clearance is provided between the outer periphery of the developer conveying screw 320 and that of the spring member 350 and the inner surface of the pipe member 340 to enhance the developer conveying effect and reliably scrape off the toner particles adsorbed to the inner surface of the pipe member 340 so that developer may be conveyed on a stable basis.

While the developer conveying screw 320 may be elongated without using the spring member 350 to convey developer to a desired position, the developer conveying route may have to be formed straight with such an arrangement. On the other hand, developer can be conveyed to a desired position if the developer conveying route shows curvatures provided that a spring member 350 is introduced into the developer conveying route so that restricting conditions can be lessened by introducing such a spring member.

Figure 24:
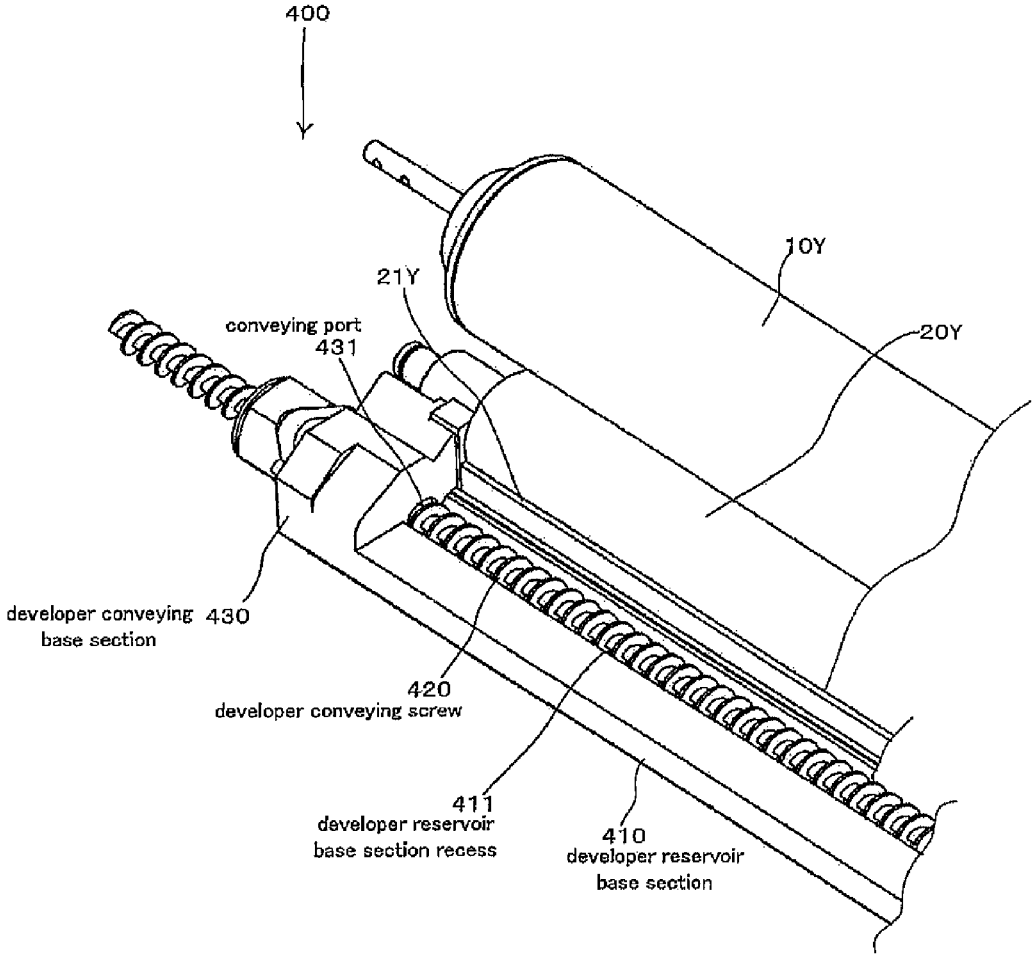
FIG. 24 is a schematic perspective view of the developer conveying apparatus of the developer reservoir 24Y.

While this embodiment is adapted to convey the developer scraped off from the image carrier 10, the present invention is by no means limited to such an arrangement and a developer conveying apparatus according to the present invention can be arranged at any of various positions in FIG. 1. The developer conveying apparatus applied to the developer reservoir 24Y has a configuration substantially same as the developer conveying apparatus applied to the image carrier 10. FIG. 24 is a schematic perspective view of the developer conveying apparatus 400 applied to the developer reservoir 24Y. The description given above by referring to FIG. 17 is also applicable to this embodiment. In particular, the developer conveying apparatus 400 includes a developer reservoir base section 410, a developer reservoir base section recess 411, a developer conveying screw 420, a developer conveying base section 430 and a conveying port 431.

The developer conveying apparatus of this embodiment can be applied not only to the developer reservoir 18Y and the developer reservoir 24Y but also to the developer reservoir 15Y. Additionally, the developer conveying apparatus of this embodiment can also be applied not only to the developer reservoirs of the developing unit 30Y for yellow but also to the developer reservoirs of the developing units 30M, 30C, 30K of the other colors and to the developer reservoir 47 arranged near the tension roller 42 and the developer reservoir 63 of the secondary transfer unit 60 of the image forming apparatus.

Thus, with the above-described other embodiment of the present invention, residual liquid developer that is electrically charged and in which toner particles can agglomerate and the toner density can be nonuniform can be conveyed smoothly. Then, as a result, the process of recycling residual liquid developer and that of disposing residual liquid developer as waste cannot be conducted smoothly.

Additionally, with the above-described other embodiment, since toner particles in electrically charged residual liquid developer are prevented from being electrostatically adsorbed to the surfaces of some of the component members of the developer conveying sections, a situation where the residual liquid developer being conveyed is completely blocked can be effectively avoided.

Finally, an image forming apparatus employing the above-described other embodiment of developer conveying apparatus and having the above-described configuration can improve the efficiency of conveying residual liquid developer and is freed from a structure of circulating developer in a closed loop. Thus, an image forming apparatus employing developer conveying apparatus according to the present invention and having the above-described configuration can temporarily move residual liquid developer from the developing sites to some other position in order to mix it with fresh developer, dissolve agglomerations of toner particles and nonuniformity of toner density so as to disperse toner particles in a desired manner and/or dispose residual liquid developer as waste.

While different embodiments of the present invention are described above, arrangements realized by combining appropriately selected components of those embodiments are also within the scope of the present invention.

What is claimed is:

1. An image forming apparatus comprising:

a developing roller for holding liquid developer;

a developing roller cleaning blade adapted to be brought into contact with the developing roller and scrape off the liquid developer held by the developing roller;

a reservoir base section for receiving the liquid developer scraped off by the developing roller cleaning blade, the reservoir base section having a recess of a substantial U-shape with an opened top side formed thereon, an arc angle of the recess being not less than 180°;

a conveying base section that is continuous with the reservoir base section and has a conveying port formed thereon;

a conveying member arranged in the reservoir base section and the conveying base section to convey the liquid developer from the recess to the conveying port by rotating around an axis thereof; and a hollow path continuous with the conveying port, and containing the conveying member in an inside thereof and guiding the liquid developer being conveyed by the conveying member, wherein when a radius of an outer periphery of the conveying member is r1 and a radius of the conveying port is r2, while a radius of curvature of the recess is r3, they show a relationship of r1<r2<r3.

2. The apparatus according to claim 1, wherein the conveying member is a screw.

3. The apparatus according to claim 1, wherein the conveying member has a spiral blade.

4. The apparatus according to claim 1, wherein the conveying member has an attaching section provided on an end section thereof, and a spring member to be contained in the inside of the hollow path is attached in the hollow path by using the attaching section.

* * * * *